US005398379A

United States Patent [19]

Kiefer

[11] Patent Number: 5,398,379

[45] Date of Patent: Mar. 21, 1995

[54] HINGE

[75] Inventor: James Kiefer, Grand Rapids, Mich.

[73] Assignee: RAN Enterprises, Inc., Grand Rapids, Mich.

[21] Appl. No.: 144,135

[22] Filed: Oct. 27, 1993

Related U.S. Application Data

[63] Continuation-in-part of Ser. No. 997,906, Dec. 29, 1992, Pat. No. 5,361,455.

[51] Int. Cl.[6] ..... E05D 5/02; E05D 15/06

[52] U.S. Cl. ..... 16/364; 16/387

[58] Field of Search ..... 16/249, 362, 364, 374, 16/387, 272

[56] References Cited

U.S. PATENT DOCUMENTS

| | | | |
|---|---|---|---|
| 388,409 | 8/1888 | Grau | 16/364 |
| 523,304 | 7/1894 | Collins | 16/364 |
| 546,909 | 9/1895 | Spencer . | |
| 617,043 | 1/1899 | Phifer . | |
| 888,049 | 5/1908 | Squiers et al. . | |
| 891,275 | 6/1908 | Marr | 16/364 |
| 1,092,236 | 4/1914 | Wrikeman . | |
| 1,360,284 | 11/1920 | Gagnon . | |
| 1,469,525 | 10/1923 | Nadolney . | |
| 1,481,142 | 1/1924 | Minton et al. . | |
| 2,211,581 | 8/1940 | Ross | 16/364 |
| 4,305,614 | 12/1981 | Holka et al. . | |
| 4,407,044 | 10/1983 | Iseki . | |
| 5,067,201 | 11/1991 | Marchione . | |
| 5,095,582 | 3/1992 | Oblsson . | |
| 5,297,314 | 3/1994 | Bender et al. | 16/270 |

FOREIGN PATENT DOCUMENTS

| | | | |
|---|---|---|---|
| 82087 | 6/1983 | European Pat. Off. | 16/362 |
| 2620759 | 3/1989 | France . | |
| 398963 | 9/1933 | United Kingdom . | |

*Primary Examiner*—Lowell A. Larson
*Assistant Examiner*—Donald M. Gurley
*Attorney, Agent, or Firm*—Price, Heneveld, Cooper, DeWitt & Litton

[57] ABSTRACT

An extendable hinge is provided including a hinge base attachable to a vehicle, a panel bracket attachable to a vehicle body panel such as rear gate or trunk lid, and a hinge member pivotally attachable to the hinge base and slideably attachable to the panel bracket. The hinge base and the hinge member include a "camelback" bend for increased strength. The panel bracket is configured with a low profile and the hinge member is configured to slideably receive the panel bracket so that a minimum amount of space is consumed and further so that the panel bracket can be slideably moved within the hinge member from an extended position which facilitates painting to a retracted position which positions the vehicle body panel for optimal aesthetics. Flanges on the hinge member and the panel bracket define integral stops that engage to limit the panel movement at the extended and retracted positions.

24 Claims, 15 Drawing Sheets

HINGE

CROSS-REFERENCE TO RELATED APPLICATION

This is a continuation-in-part application of U.S. Ser. No. 07/997,906, filed Dec. 29, 1992, now U.S. Pat. No. 5,361,445.

BACKGROUND OF THE INVENTION

The present invention concerns hinges, and in particular a vehicle hinge facilitating painting and assembly of the vehicle.

It is particularly advantageous to paint vehicle body panels simultaneously with the vehicle during assembly since this reduces or eliminates color mismatches and also provides assembly plant advantages such as reduced paint waste and labor. However, in modern vehicles, the body panels are positioned close to each other for improved appearance, reduced wind resistance and noise, and the like. Hence, some vehicle body panels are not positioned on the vehicle with enough clearance around the body panel edges to allow adequate painting of the body panel edges and the adjacent area on the vehicle. For example, in a sedan or minivan, the vehicle rear gate or trunk lid includes an edge adjacent the rear window upper sheet metal of the vehicle body, which edge and window lower sheet metal cannot be adequately painted if the rear gate is closed, but which edge shadows the rear window lower sheet metal if the rear gate is opened. Hence, present vehicle assembly techniques either include removing the rear gate lid, or include a special painting operation where the rear gate is painted in a first position and then painted again along the problem edge area with the rear gate held in a second position. A hinge such as that of the present invention can aid in such special painting operations.

Further, it is desirable to provide a hinge that is compact so that a minimum amount of space is used and so that optimal visual aesthetics are achieved, while still satisfying the necessary functional requirements of the hinge. Yet another desirable feature is a hinge made from parts that minimize the amount of scrap trimmed from raw blanks when making the hinge, thus minimizing material costs, and also that minimizes the amount of subassembly operations required for assembly.

Thus, a hinge is desired to facilitate improved painting and assembly of a vehicle, but which is compact, low in material cost and does not require multiple secondary forming operations.

SUMMARY OF THE INVENTION

The present invention includes a hinge having a first hinge member, a second hinge member pivotally connected to the first hinge member and having first opposing flanges and a first connecting flange interconnecting the opposing flanges to thus define a track, and a third hinge member slideably connected to the second hinge member in the track. The third hinge member is moveable between a retracted position and an extended position. The hinge further includes at least one stop located on one of the second and third hinge members for engaging the other of the second and third hinge members to limit the movement of the third hinge member relative to the second hinge member, the at least one stop defining at least one of the retracted and extended positions.

In another aspect, the hinge includes a first hinge member having a mounting end defining a U-shaped section and a first pivot supporting end also defining a U-shaped section extending from the vehicle mounting end, the vehicle mounting end and the first pivot supporting end including continuous flanges so as to define a first "camelback" bend. The hinge further includes a second hinge member including a second pivot supporting end defining a U-shaped section and a slide receiving end defining a U-shaped section, the second pivot supporting end and the slide receiving end including continuous flanges so as to define a second "camelback" bend. The hinge still further includes a third hinge member including a vehicle panel mounting end and a slide configured with opposing edges for slideably engaging the slide receiving end of the second hinge member. The third hinge member is moveable between an extended position and a retracted position on the second hinge member and still further includes means for securing the third hinge member in either of the extended position or the retracted position.

The preferred embodiment of the present invention includes a number of advantages over previously known extendable hinges. The preferred embodiment results in a weight savings over previously known extendable hinges, and further results in much less scrap being generated during the formation of the parts making up the hinge. Further, the parts are readily formable without the need for multiple secondary operations and non-die forming operations such as welding. Still further, the preferred embodiment has a low profile and is very compact, thus requiring a minimum amount of space. Also, the hinge pin rotates on extruded holes, thus increasing service life.

These and other features, advantages and objects of the present invention will be further understood and appreciated by those skilled in the art by reference to the following specification, claims and appended drawings.

DETAILED DESCRIPTION OF THE PREFERRED EMBODIMENT

Figure 14:
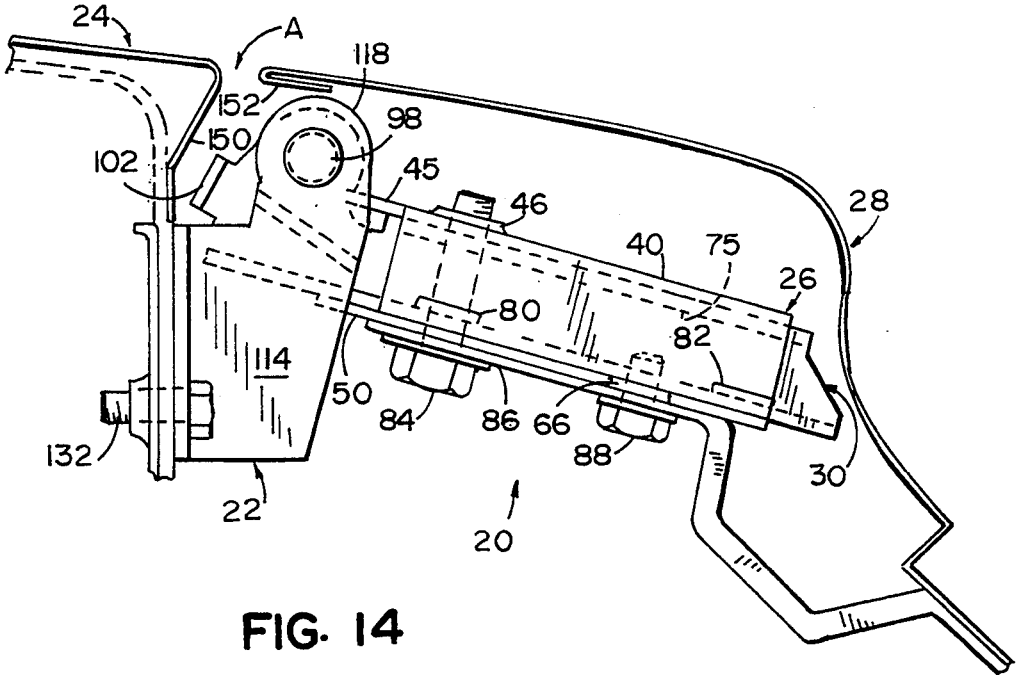
FIG. 14 is a side view of the hinge assembly in a retracted position with the vehicle rear gate attached, the hinge assembly also being shown in a closed position.
Figure 16:
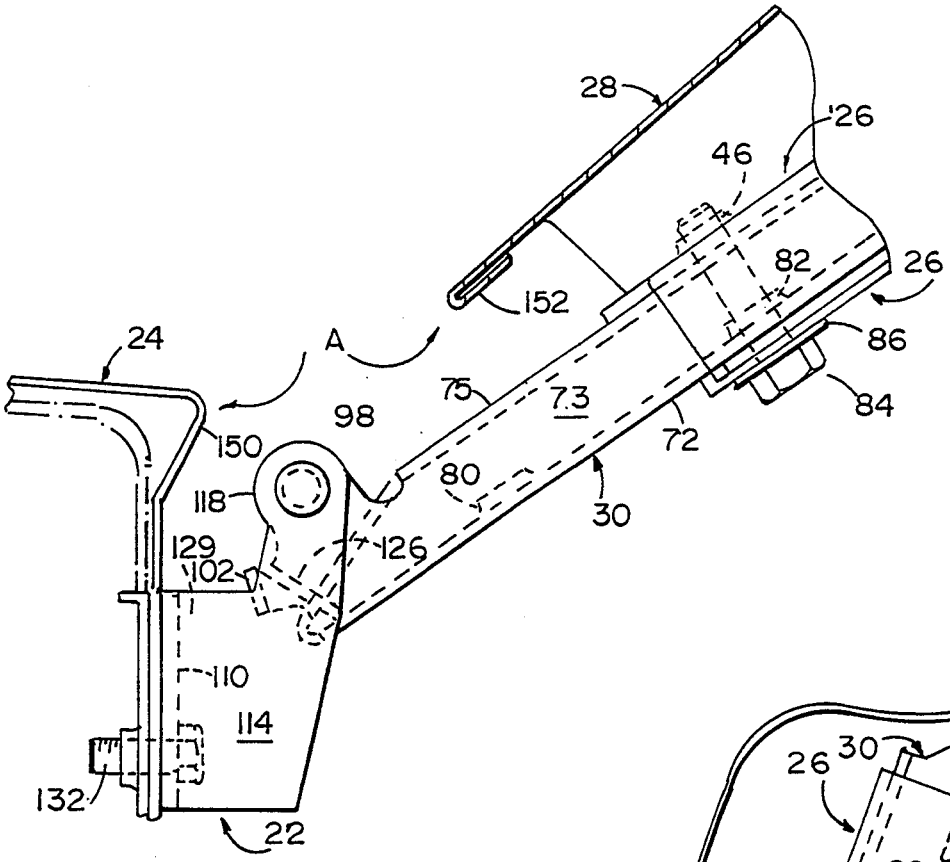
FIG. 16 is a side view of the hinge assembly in the extended position with the vehicle rear gate attached, the hinge assembly also being shown in an intermediate manufacture/painting facilitating position.
Figure 15:
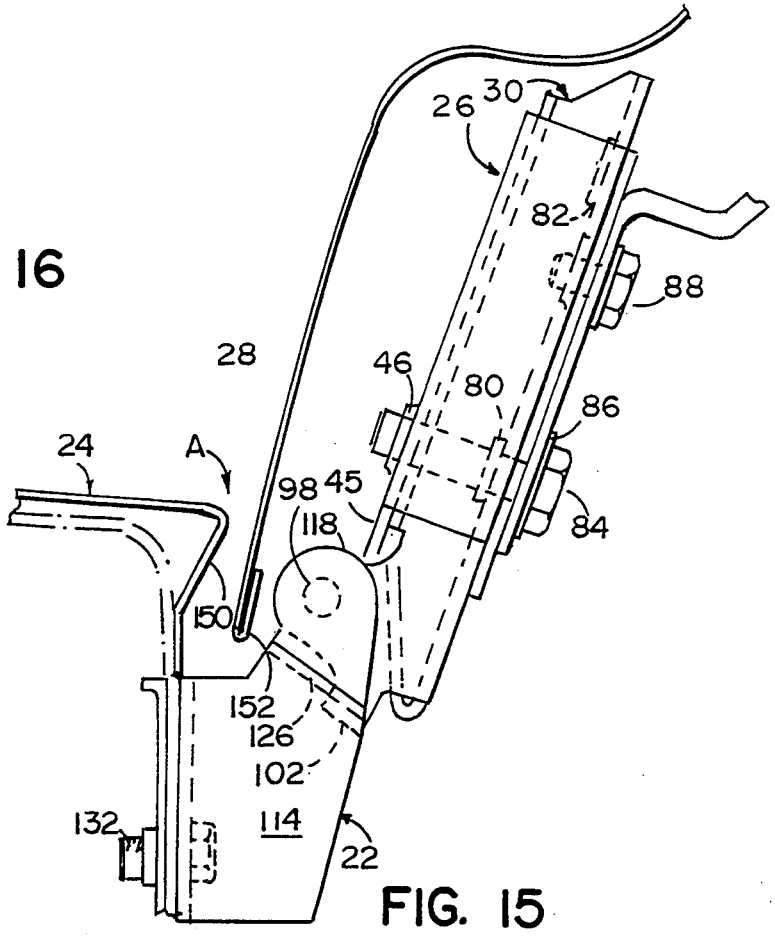
FIG. 15 is a side view of the hinge assembly in a retracted position with the vehicle rear gate attached, the hinge assembly also being shown in a fully open position.

A hinge assembly 20 (FIGS. 1 and 14) embodying the present invention includes a hinge base 22 adapted to attach to a vehicle 24, a panel bracket 26 adapted to attach to a vehicle body panel such as a rear gate or trunk lid 28, and a hinge member 30 pivotally connected to the hinge base 22 and slideably connected to the panel bracket 26. Hinge 20 is extendable so that body panel 28 can be moved to provide clearance between vehicle 24 and body panel 28 to facilitate simultaneously painting the vehicle 24, the body panel 28, and in particular the area "A" therebetween, without removing body panel 28 from vehicle 24. As can be seen in FIGS. 14 and 15, area "A", and in particular surfaces 150 and 152, are inaccessible and "shadowed" so that adequate paint coverage is a problem when body panel 28 is positioned in a final assembly position. However, area "A" can be made accessible by use of the present hinge 20, as noted below and generally shown in FIG. 16.

Figure 5:
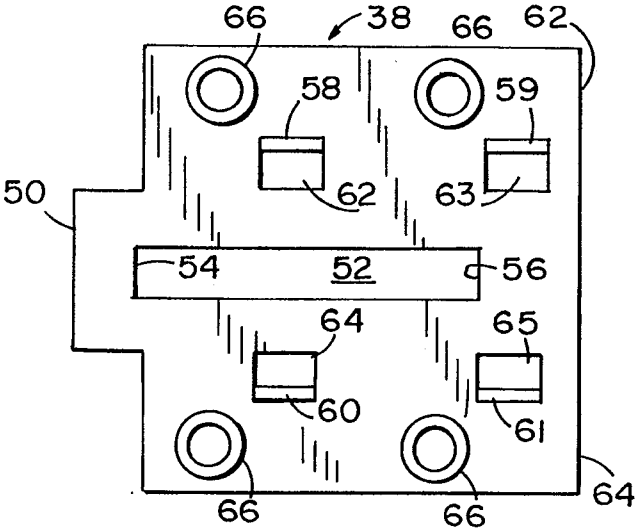
FIGS. 5–6 are orthogonal views of a second half of a panel bracket.
Figure 6:
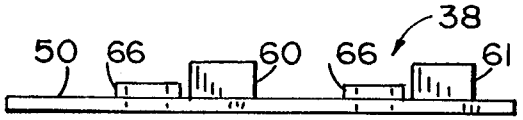
Figure 4:
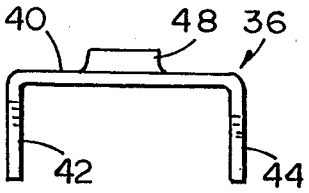
FIGS. 2–4 are orthogonal views of a first half of a panel bracket.
Figure 2:
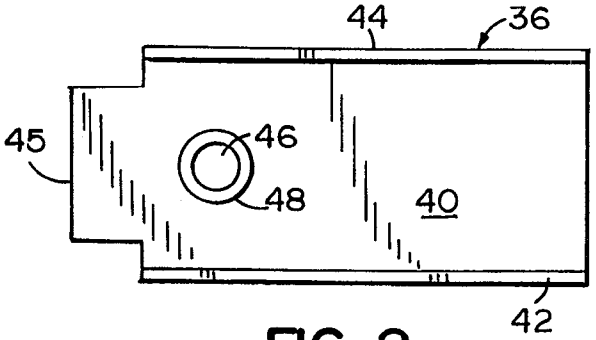
Figure 3:
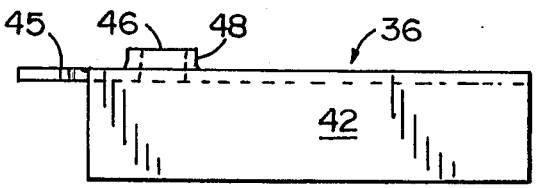

More particularly, panel bracket 26 (FIG. 1) is a welded assembly made from a first half 36 (FIGS. 2–4) and a second half 38 (FIGS. 5–6). First half 36 (FIGS. 2–4) is an elongate sheet metal part having a C-shaped cross section including a planar middle section 40 and side flanges 42 and 44. A tongue 45 extends from middle section 40 forward of side flanges 42 and 44. A hole 46 is centrally located in middle section 40 near tongue 46, hole 46 being defined in part by an extruded lip 48 that protrudes from middle section 40 in a direction opposite side flanges 42 and 44.

Second half 38 (FIGS. 5–6) is a planar sheet metal part that is generally rectangular in shape. Second half 38 has a length that generally corresponds to the length of first half 36, and includes a tongue 50 which corresponds to tongue 45 of first half 38. A slot 52 is defined longitudinally in second half 38 and includes a first end 54 and a second end 56. Four tabs 58, 59, 60 and 61 are bent upwardly perpendicularly to the planar body of second half 38. Tabs 58–61 are spaced apart in a rectangular pattern to closely receive therebetween side flanges 42 and 44 of first half 36, tabs 58–61 locating first half 36 on second half 38 from side-to-side. Notably, side flanges 42 and 44 could also locate fore-to-aft on tabs 58–61 or on holes 62–65 formed adjacent tabs 58–61, though this is not presently contemplated as being necessary. Second half 38 includes flange portions 62 and 64 that extend outwardly beyond tabs 58–61. These flange portions 62 and 64 include extruded attachment holes 66, holes 66 being useful to secure second half 38 to body panel 28 by use of screws 88.

First and second halves 36 and 38 are welded together to form panel bracket 26 (FIG. 1) such that tongues 45, 50 are in registry and aligned with one another. Bracket 26 has a tubular sleeve-like shape defining an elongate sleeve-like pocket 68 having a rectangular cross-sectional shape, the rectangular shape being preferable over a round cross-sectional shape to control rotation in pocket 68. Pocket 68 is particularly adapted to slideably telescopingly receive hinge member 30, as described below. Notably, hole 46 is located above slot 52 near slot end 54 in the welded arrangement of panel bracket 26.

Figure 1:
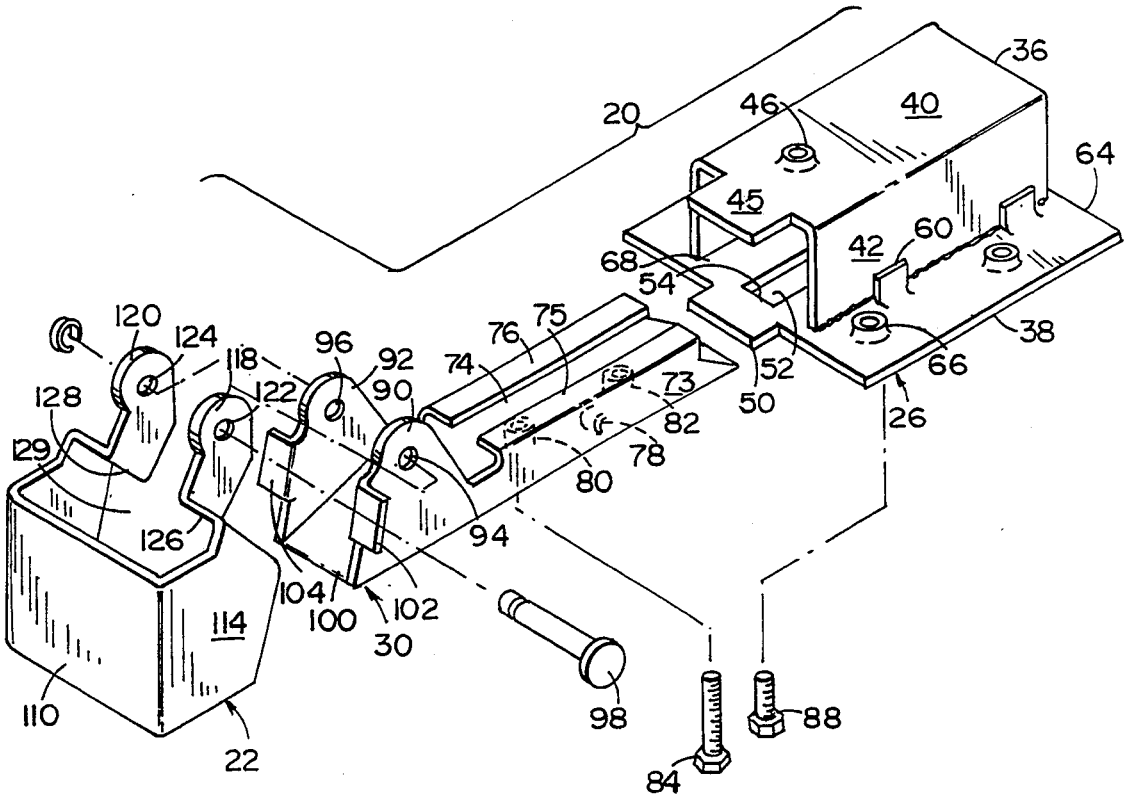
FIG. 1 is an exploded perspective view of a hinge assembly embodying the present invention.
Figure 13:
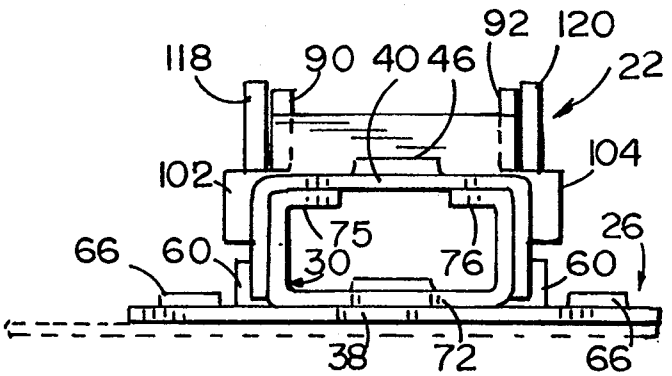
FIG. 13 is an end view of the hinge assembly including the panel bracket, the movable hinge member and the hinge base.
Figure 9:
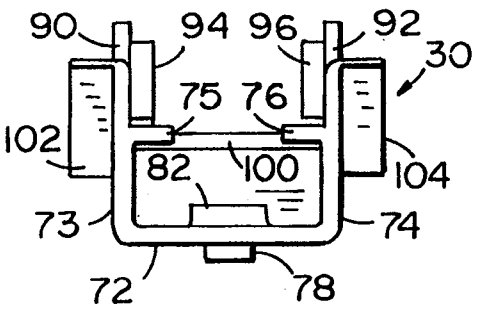
FIGS. 7–9 are orthogonal views of a movable hinge member.
Figure 7:
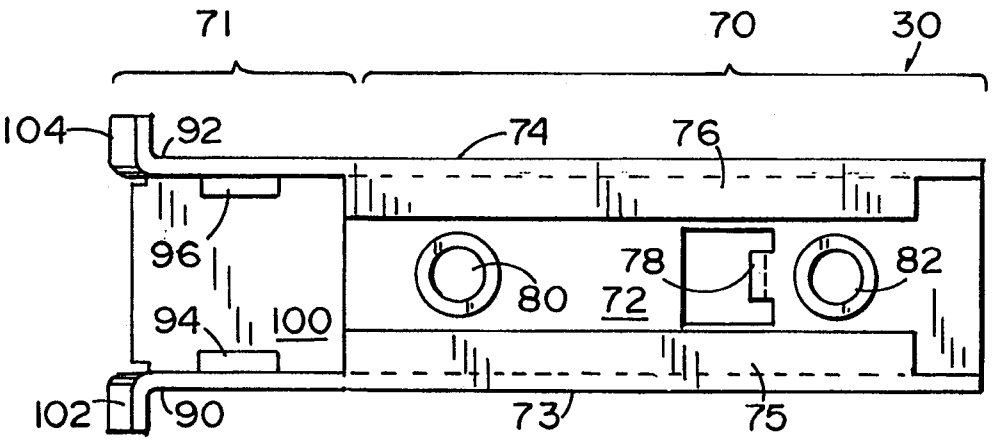
Figure 8:
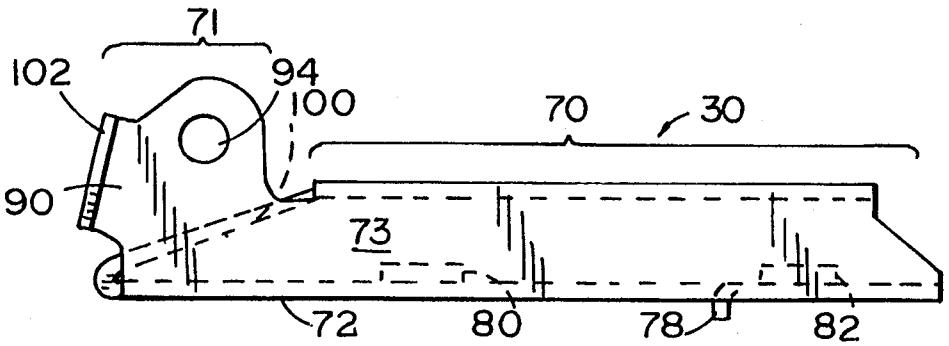

Hinge member 30 (FIGS. 7–9) is formed from sheet metal and includes an elongated arm 70 and a pivot pin receiving end 71. Arm 70 has a C-shaped cross section (FIG. 9) defined by lower wall 72, side walls 73 and 74, and upper wall sections 75 and 76. Arm 70 is shaped so that walls 72–76 closely slideably fit within pocket 68 of panel bracket 26 (FIGS. 1 and 13). A tab 78 extends downwardly from lower wall 72 (FIG. 8), tab 78 being optimally located to engage slot ends 54 and 56 in second half 38 to limit the stroke of hinge member 30 as hinge member 30 slideably moves in pocket 68 of panel bracket 26. Notably, it is contemplated that tab 78 could be replaced by a screw or other limiting means, or that a rectangular solid bar could be substituted for all of arm 70, however the present arrangement is believed preferable since it offers the advantages of reduced weight, reduced cost, reduced number of parts, and reduced complexity. A pair of spaced extruded holes 80 and 82 extend inwardly from lower wall 72 of arm 70 toward the center of arm 70.

A self-tapping screw 84 (FIGS. 15 and 16) is insertable through slot 52 and into hole 80 or 82. With hinge member 30 in an extended position (FIG. 16) screw 84 can be extended through slot 52 and into hole 82 and hole 46, where screw 84 can be tightened to clampingly securely hold hinge member 30 in the extended position. Screw 84 includes a washer-like flange 86 on the screw head adapted to clampingly engage and hold panel bracket 26 to hinge member wall 72. Alternatively, with hinge member 30 in a retracted position (FIGS. 14 and 15), screw 84 can be extended through slot 52 and into hole 80 and hole 46, where it can be tightened to securely hold hinge member 30 in the retracted position.

Pivot pin receiving end 71 of hinge member 30 (FIGS. 7–9) includes parallel upright flanges 90 and 92 that align with side walls 73 and 74, flanges 90 and 92 including aligned holes 94 and 96 for receiving pivot pin 98 (FIG. 1). Optimally, holes 94 and 96 are extruded inwardly to provide increased strength and bearing surface for receiving pivot pin 98. Wall 72 extends forward of arm 70 between flanges 90 and 92, and includes a tongue 100 that is bent backwardly at an angle to wall 72. Tongue 100 abuts the inside of flanges 90 and 92 and supportingly maintains the parallel spacing of the flanges. Two tabs 102 and 104 are located at the outer longitudinal edges of flanges 90 and 92, and extend laterally outwardly.

Figure 12:
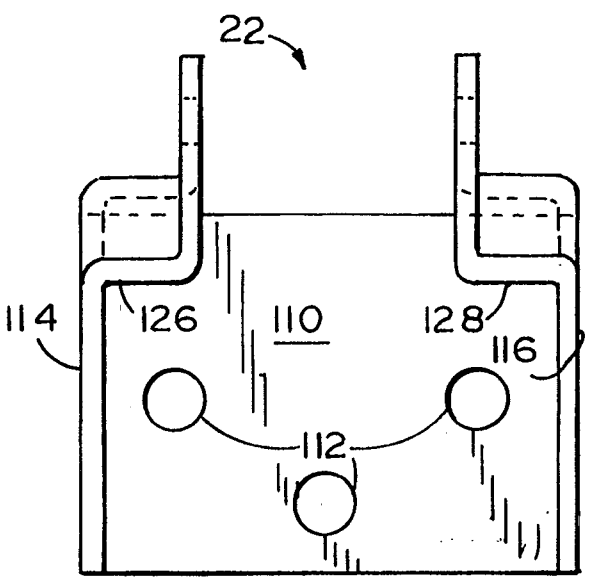
FIGS. 10–12 are orthogonal views of a hinge base, FIG. 11 being a fragmentary view.
Figure 11:
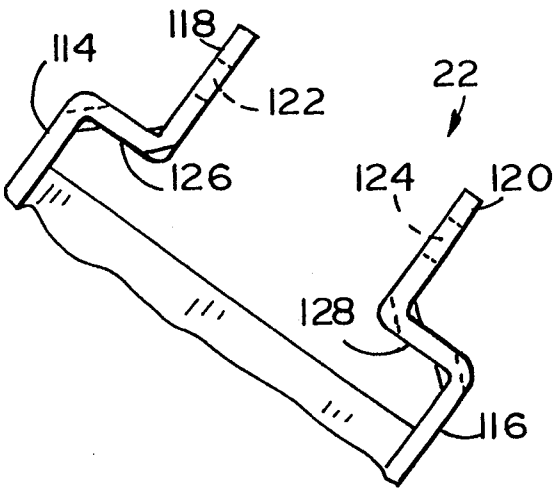
Figure 10:
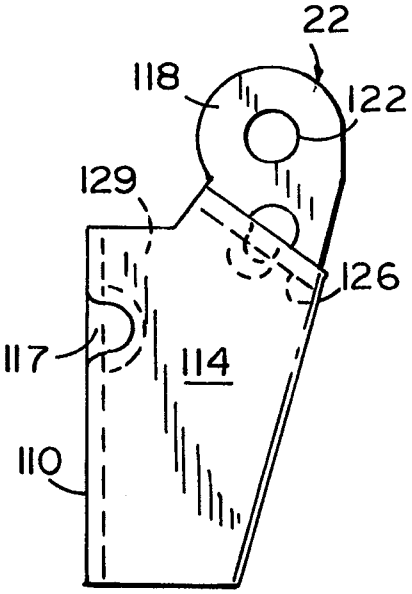

Hinge base 22 (FIGS. 10–12) includes a mounting wall 110 with mounting holes 112 for attaching hinge base 22 to the vehicle 24. Hinge base 22 also includes spaced side flanges 114 and 116 that extend normally to mounting wall 110, gussets 117 being provided at the intersection of walls 110, 114 and 116 for increased stability of flanges 114 and 116. A pair of spaced parallel tabs 118 and 120 extend from flanges 114 and 116 and are supported by side flange offset sections 126 and 128. Tabs 118 and 120 are spaced apart a predetermined distance to closely receive flanges 90 and 92 of hinge member 30 (FIG. 13). Offset tabs 118 and 120 include holes 122 and 124 that align with holes 94 and 96 of hinge member flanges 90 and 92, so as to receive pivot pin 98 (FIG. 1). Gussets similar to gussets 117 are added as needed to stabilize tabs 118 and 120, and offset sections 126 and 128.

With hinge member 30 pivotally attached to hinge base 22, hinge member tab 102 fits between the space 129 (FIGS. 10 and 16) defined by tab-like offset section 126 and base mounting wall 110 as hinge member 30 is pivoted from a closed position to an open position, tab 102 abuttingly engaging tab-like offset section 126 as hinge member 30 reaches the fully open position (FIG. 15). Thus, tab-like section 126 acts as a stop for limiting the rotational movement of hinge member 30 on hinge base 30. Likewise, tab 104 (FIG. 1) simultaneously moves between tab-like offset section 128 and base mounting wall 110 to abuttingly engage tab-like offset section 128 at the fully open position of hinge member 30, sections 126 and 128 acting together to limit hinge 20 and body panel 28 to a maximum fully open position.

OPERATION

Having described the hinge components and interrelationship of hinge components, the uses and advantages of the present invention will become apparent to one of ordinary skill in the art. Hinge panel bracket halves 36 and 38 are initially welded together (FIG. 1) to form panel bracket 26 with hinge member 30 being located in pocket 68 defined in panel bracket 26. As thus formed, hinge member 30 is telescopingly slideable in panel bracket 26 with hinge member tab 78 engaging the ends of slot 52 in panel bracket 26 to limit the travel of hinge member 30 in panel bracket 26.

Panel bracket 26 is then securely attached to the body panel such as rear gate 28 in a predetermined location by screws 88, and the hinge base 22 is also securely attached to the vehicle in a predetermined location such as by screws 132. Hinge member 30 is then pivotally connected to hinge base 22 by pivot pin 98. If net mounting holes or alignment fixtures are used on vehicle 24 and body panel 28, hinge 20 can be installed in the extended position without a need to separately align body panel 28 to vehicle 24 since the net mounting holes provide the necessary alignment.

Hinge 20 is extendable by sliding panel bracket 26 outwardly on hinge member 30 (FIG. 16), the extending movement being limited by tab 78 in slot 52. Hinge member 30 is secured in the extended position by use of screw 84, screw 84 being inserted through slot 52 and holes 82 and 46. By positioning hinge member 30 in an intermediate position between the open and closed positions (FIG. 16), body panel 28 is spaced from vehicle 24 to provide clearance for painting area "A", and in particular around the facing surfaces 150 and 152 of body panel 28 and vehicle 24. Thus, area "A" can be painted without removing body panel 28 from vehicle 24 and without requiring manual painting or special manipulation of body panel 28 on vehicle 24.

After painting, screw 84 is removed, and hinge member 30 is slideably moved to the retracted position (FIGS. 14 and 15) where screw 84 is reinstalled through slot 52, and holes 80 and 46. Optimally, body panel 28 has already been aligned on vehicle 24, and realignment is not necessary. It is contemplated that a washer (not shown) could be placed on screw 84 before tightening, the washer being useful to cover any exposed unpainted areas to prevent any corrosion around the screw head. With hinge member 30 thus secured, panel 28 and hinge member 30 can be rotated between the full open position (FIG. 15) and full closed position (FIG. 14) while maintaining acceptably tight clearances between body panel 28 and vehicle 24.

SECOND EMBODIMENT

Figure 18:
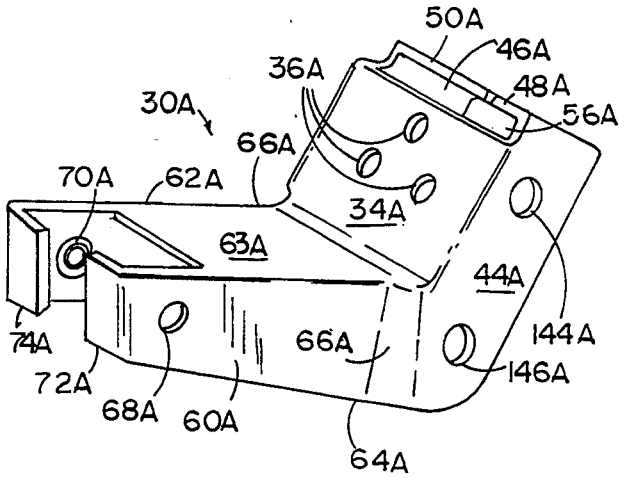
FIG. 18 is a perspective view of a hinge member for the second hinge assembly, the hinge member being adapted for use in a two-piece non-telescoping hinge arrangement.

A second hinge 20A (FIGS. 20 and 21) embodying the present invention includes a hinge base 22A adapted to attach to a vehicle 24A, a panel bracket 26A adapted to attach to a vehicle body panel such as a rear gate 28A, and a hinge member 30A' pivotally connected to the hinge base 22A and slideably connected to the panel bracket 26A. Alternately, hinge 20A may be a two-piece, non-extendable assembly using hinge member 30A (FIG. 18). In its extendable form using hinge member 30A' and panel bracket 36A, hinge 20A is similar to hinge 20 insofar as hinge 20A is extendable so that body panel 28A can be moved to provide clearance between vehicle 24A and body panel 28A to facilitate simultaneous painting of both parts with clearance therebetween to eliminate "shadowing" which causes incomplete paint coverage. However, hinge 20A also provides: 1) the advantage of attaching the body panel 28A in a different manner than hinge 20 to reduce potential intrusion of water into body panel 28A, 2) the advantage of a redesigned hinge base 22A having reduced weight and increased strength due to use of a "camelback" bend, and 3) the advantage of a hinge member 30A that can be used in a two-piece hinge arrangement or is reworkable to form hinge member 30A' so that it can be used in a three-piece telescoping hinge arrangement. Further, hinge 20A includes components made completely by stamping which components do not require welding and thus offer manufacturing advantages due to reduced secondary operations.

More particularly, hinge member 30A (FIG. 18) is a part stamped from a single sheet of metal. Hinge member 30A includes an attachment portion formed by planar section 34A with holes 36A therein for attaching hinge member 30A directly to body panel 28A. Notably, body panel 28A (FIG. 20) is made from an outer panel having an edge 152A and an inner reinforcement panel 155A, and planar section 34A bolts to the exposed surface 157A on the vehicle interior side of body reinforcement panel 40 A. Thus, unlike hinge 20 in which panel bracket 26 mounts between the inner and outer panels forming body panel 28 (see FIGS. 14–16), hinge member 30A bolts to the exposed side of body panel 28 so as to reduce the tendency to communicate moisture into the inside of body panel 28A. Further, inner reinforcement panel 155A can be closed against outer panel 152A, thus providing an arrangement which is more easily sealed.

Hinge member 30A (FIG. 18) further includes spaced flanges 44A and 46A that extend perpendicularly from opposing sides of planar section 34A in a U-shaped arrangement, flanges 44A and 46A stabilizing planar section 34A. Further, opposing tab-like stops 48A and 50A are located on one end of flanges 44A and 46A proximate one side of planar section 34A. The upper edges 52A and 54A are spaced below planar section 34A and define a gap 56A therebetween.

A pair of spaced apart arms 60A and 62A and interconnecting planar section 63A extend from flanges 44A and 46A and planar section 34A from an end opposite stops 48A and 50A. Arms 60A and 62A extend parallel each other and include a pair of corresponding bends 64A and 66A near their bottom to reduce the spacing between their length. Near the ends of arms 60A and 62A are inwardly extruded holes 68A and 70A useful for receiving a pivot pin (not shown). Holes 68A and 70A are extruded for increased strength and to provide an enlarged surface area for increased service life. On the ends of arms 60A and 62A are inwardly extending flanges 72A and 74A useful for acting as a stop on hinge base 22A. Members 34A, 44A, 46A, 60A, 62A and 63A form a "camelback" bend having increased strength, as discussed below.

Figure 17:
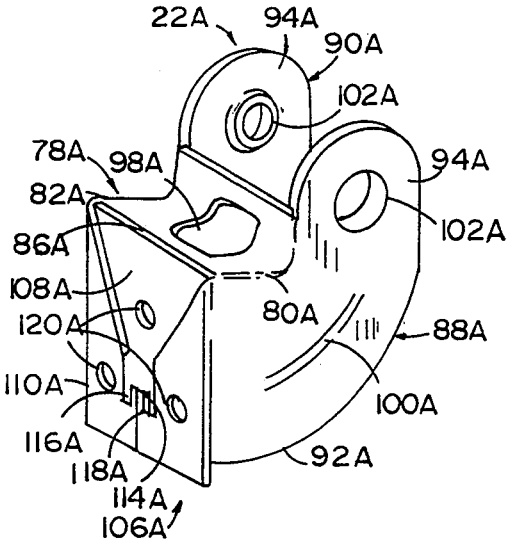
FIG. 17 is a perspective view of a hinge base for a second hinge assembly embodying the present invention.

Hinge base 22A (FIG. 17) includes a shaped center web 78A with opposite side edges 80A and 82A, outer edge 84A and inner edge 86A. A pair of spaced apart L-shaped webs 88A and 90A are bent from side edges 80A and 82A, respectively, with center web 78A optimally being connected to both of the legs 92A and 94A of L-shaped webs 88A and 90A. This arrangement of center web 78A provides increased strength due to the working of the material when forming center web 78A and L-shaped webs 88A and 90A, and is sometimes referred to as a "camelback" bend. Gussets or creases can be added for further strengthening central web 78A and L-shaped webs 88A and 90A. For example, shown is a depressed area or gusset 98A which strengthens center web 78A and a crease 100A which strengthens L-shaped web 88A. Outer leg 94A of each L-shaped web 88A and 90A includes a hole 102A, holes 102A being aligned and adapted to receive a pivot pin to form the axis of rotation of the hinge 20A. Notably, when pivoted fully open, arm flanges 72A and 74A abut outer edge 84A, thus preventing over-travel or over-extension of hinge 20A.

An attachment structure 106A (FIG. 17) is formed on hinge base 22A by bending a triangularly-shaped first tab 108A on inner edge 86A into planar alignment with second and third tabs 110A and 112A extending from the inner edges of inner legs 92A. The tip of first tab 108A includes a recess 114A for matingly receiving teeth 116A and 118A on the inner sides of second and third tabs 110A and 112A, respectively, This allows first tab 108A to effectively capture tabs 110A and 112A, tires assuring that attachment structure 106A is a stable arrangement as bolted to the vehicle 24A. Each tab 108A, 110A and 112A includes a hole 120A for receiving a bolt to retain hinge base 22A to vehicle 24A.

Figure 19:
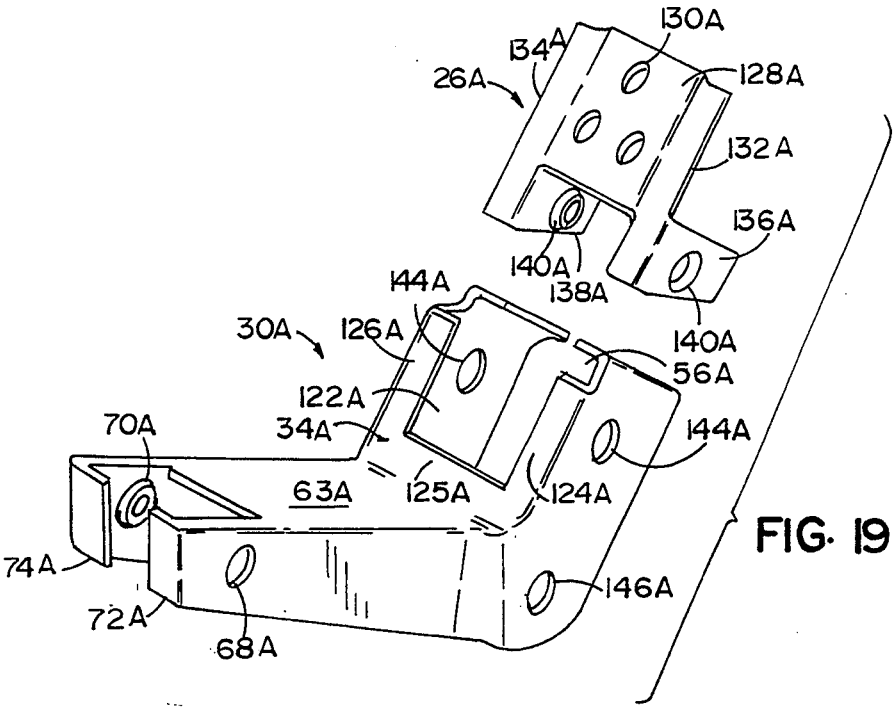
FIG. 19 is a perspective view of the hinge member shown in FIG. 18 but modified for use in a three-piece telescoping hinge arrangement, and also showing a panel bracket.

As thus described, hinge base 22A and hinge member 30A are interconnectable in a two-piece arrangement by positioning a pivot pin (not shown) through aligned holes 102A and holes 68A. However, advantageously, hinge member 30A is configured so that it can be reworked by stamping to form a part 30A' (FIG. 19) for use in a three-piece telescoping hinge, i.e., hinge 20A. Specifically, hinge member 30A' includes an open area around planar section 34A such that the material defining holes 36A can be stamped out to leave an enlarged aperture 122A bounded by flanges 124A, 125A and 126A in planar section 34A. Thus, hinge member 30A is formed into new part 30A' which is adapted to slideably receive panel bracket 26A. Notably, the section of material defining holes 36A can be readily punched out or cut out even after forming hinge member 30A due to the open design of the part.

Panel bracket 26A (FIG. 19) includes a center segment 128A including holes 130A arranged in a pattern substantially the same as holes 36A in the piece removed from hinge member 30A when forming hinge member 30A'. Center segment 128A is narrow enough to mateably fit within enlarged aperture 122A, and includes opposing wing-like flanges 132A and 134A that extend downwardly from the plane of segment 128A and outwardly and under flanges 124A and 126A on planar section 34A. Notably, wing-like flanges 132A and 134A slip through gap 56A and between side flanges 44A and 46A, thus acting as a guide for fore-to-aft telescoping movement of panel bracket 26A on hinge member 30A. A pair of ear-like flanges 136A and 138A extend downwardly from the inner ends of wing-like flanges 132A and 134A, and further stabilize this sliding telescoping movement. Ear-like flanges 136A and 138A include inwardly extruded holes 140A which are adapted to receive self-tapping screws. In the fully extended position, holes 140A align with holes 144A inside flanges 44A and 46A, thus securely holding panel bracket 26A in the fully extended position to facilitate painting of adjacent area located on body panel 28A and vehicle 24A (see FIG. 20). In the fully retracted position, holes 140A align with holes 146A to secure panel bracket 26A and body panel 28A in the final assembly position giving body panel 28A optimal fit to vehicle 24A (see FIG. 21). Notably, this arrangement allows pre-alignment of body panel 28A in the bodyshop as sheet metal parts are being fit to vehicle 24A, allows tile body panel 28A to be extended for painting without removing the body panel 28A thus reducing damage and on-line handling, and further permits repositioning of body panel 28A adjacent vehicle 24A in the position determined in tile bodyshop without a secondary and repetitive realignment operation on the assembly line.

Figure 20:
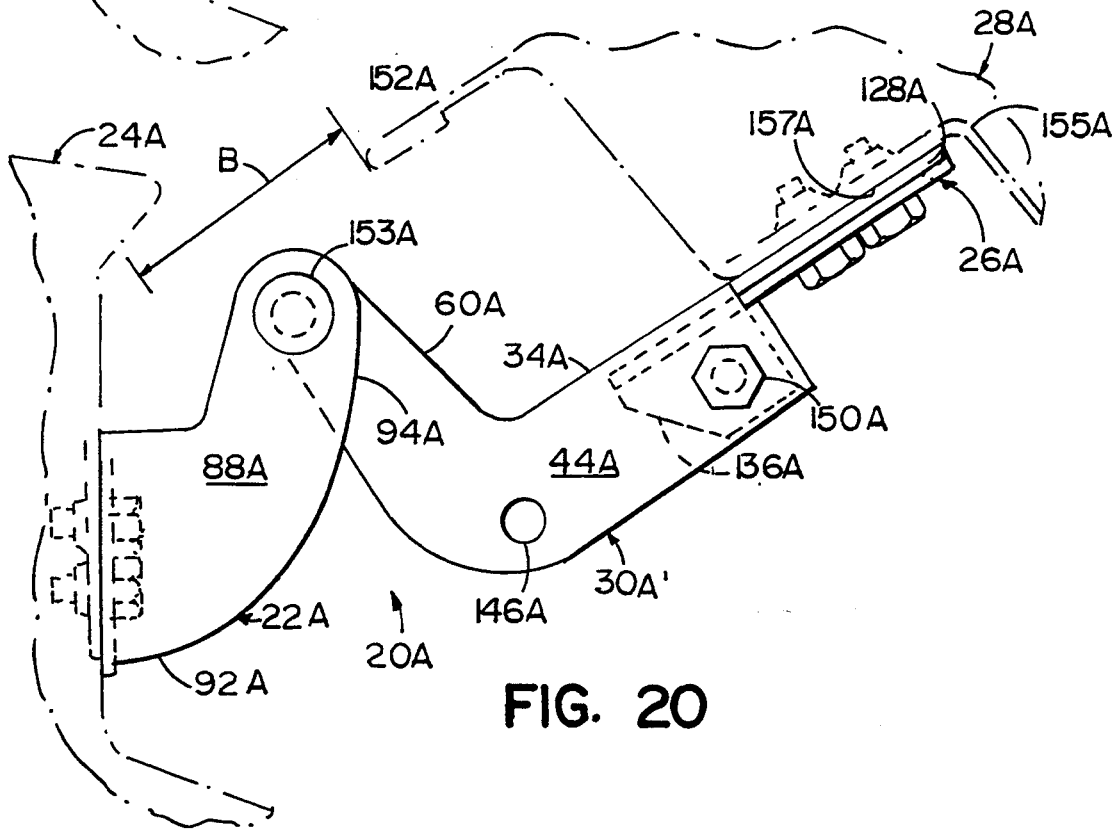
FIG. 20 is a side view of the second hinge assembly, the second hinge assembly being arranged in the three-piece telescoping hinge arrangement with the vehicle panel and the panel bracket being shown in a partially open intermediate and extended position to space the vehicle panel from the vehicle for optimal painting.
Figure 22:
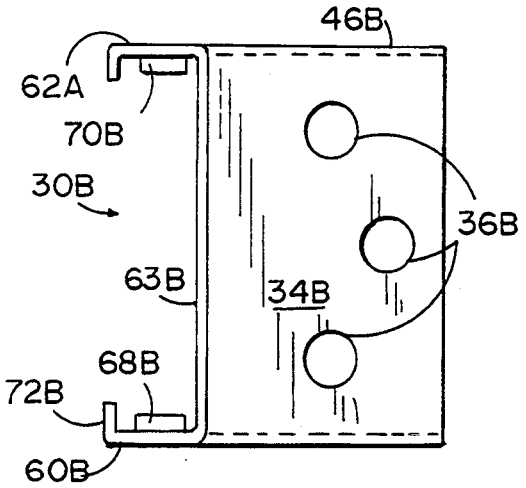
FIGS. 22–24 are orthogonal views of a hinge member for use in a third hinge assembly embodying the present invention, the hinge member being useable in a two-piece hinge arrangement as shown in FIGS. 34–36.
Figure 24:
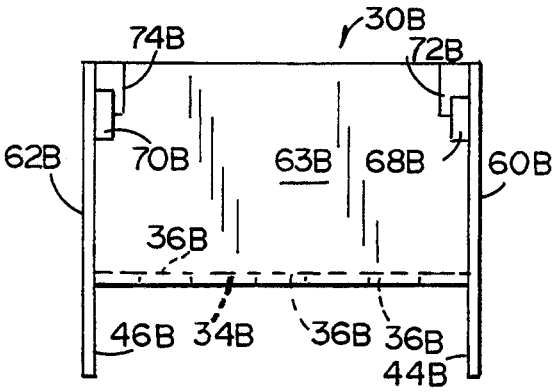
Figure 23:
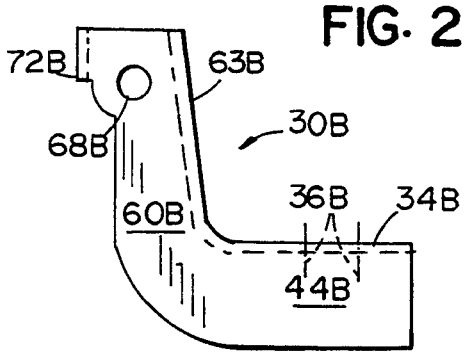

With specific reference to FIG. 20, three-piece hinge 20A is shown as pivoted to an intermediate optimal position for painting. Notably the hinge has been fully extended and a bolt 150A has been extended into each hole 144A and threadingly into hole 140A to secure panel bracket 26A in the fully extended position on hinge member 30A. Also, a pivot pin 153A connects hinge base 22A and hinge member 30A'. Notably, arrow B illustrates the increased clearance due to the extension of hinge 20A.

Figure 21:
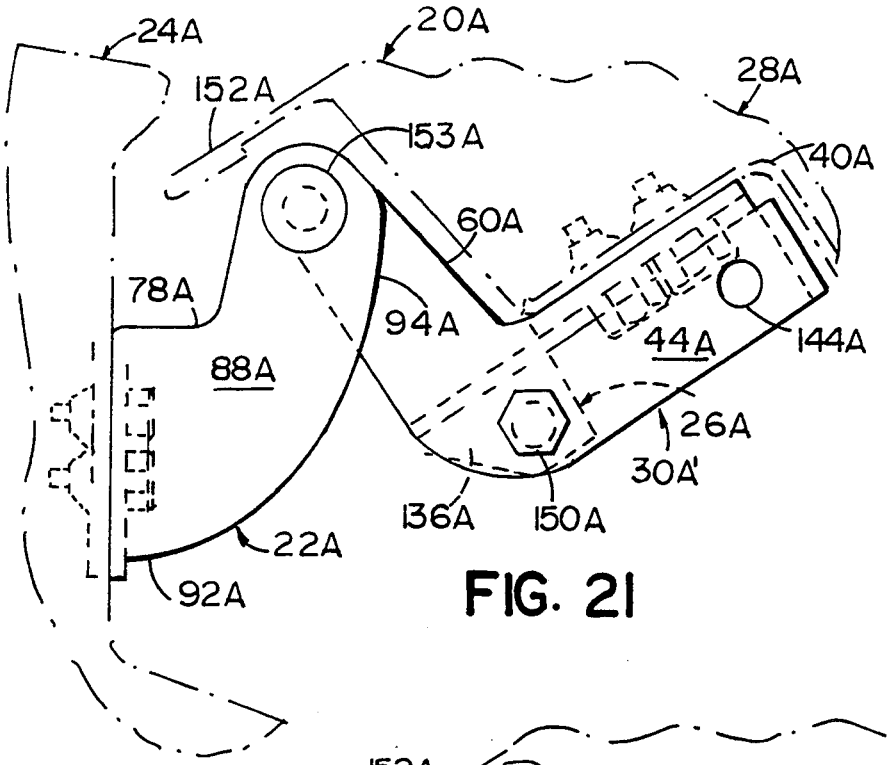
FIG. 21 is a side view comparable to FIG. 20 but with the vehicle panel and the panel bracket in a fully retracted position for final sheet metal fit on final assembly.

In FIG. 21, bolt 150A has been removed, hinge 20A has been retracted so that panel bracket 26A and body panel 28A are positioned adjacent vehicle 24A in the desired position, and bolt 150A has been reinserted in holes 146A, 140A to secure same in the finished position.

THIRD EMBODIMENT

Figure 34:
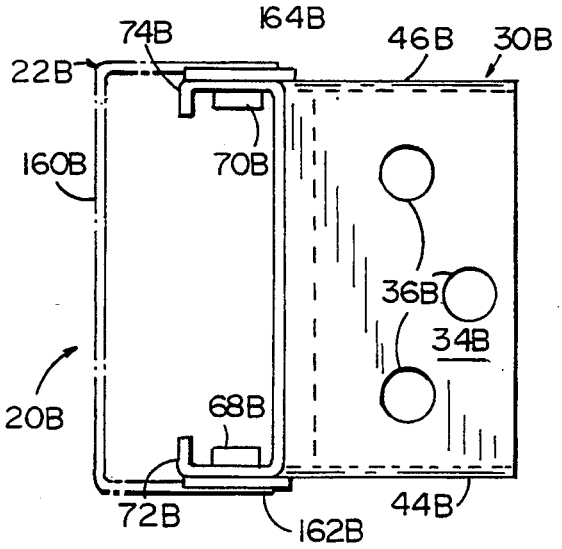
FIGS. 34–36 are orthogonal views of the two-piece hinge arrangement of the third embodiment, with the hinge base being shown in phantom in FIG. 36.
Figure 36:
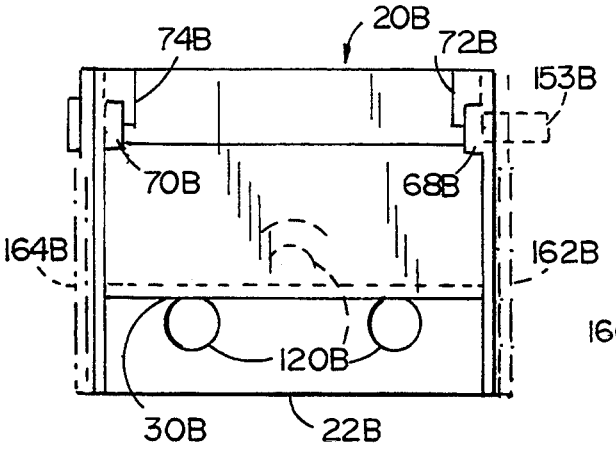
Figure 35:
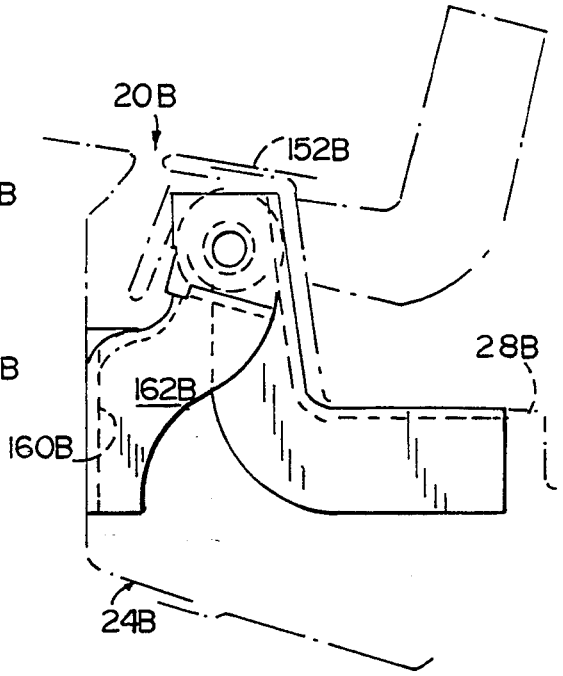
Figure 40:
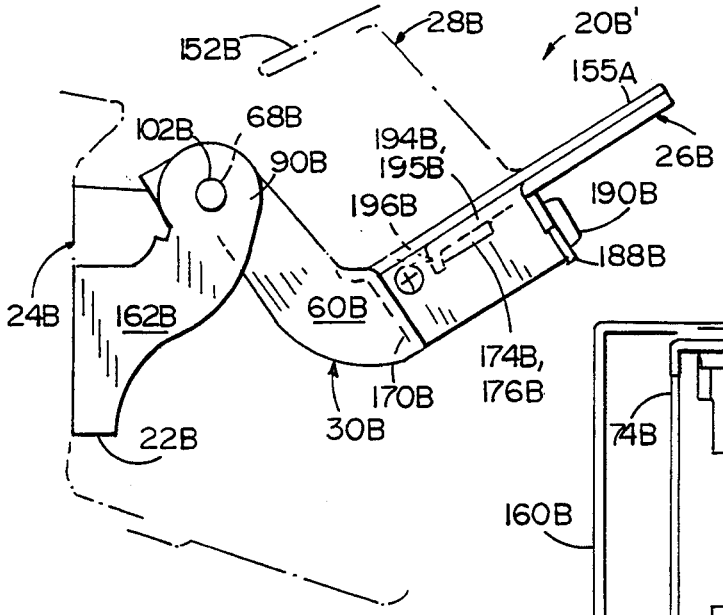
FIG. 40 is a side view of the three-piece telescoping hinge arrangement of the third embodiment, the hinge being in the extended position.
Figure 37:
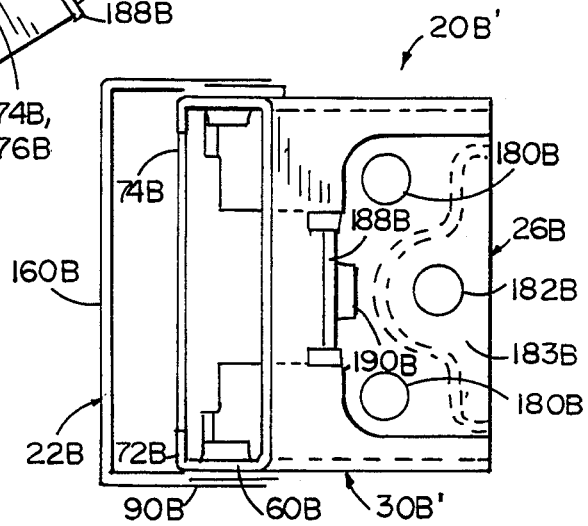
FIGS. 37–39 are orthogonal views of the three-piece telescoping hinge arrangement of the third embodiment, the hinge being in the retracted position and with the hinge base being shown in phantom in FIG. 39.
Figure 39:
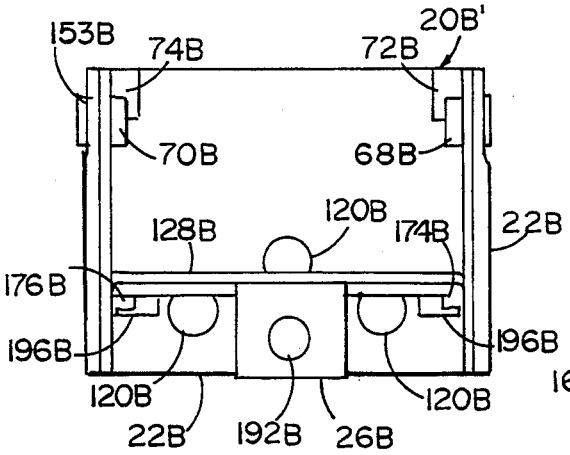

A third hinge 20B embodying the present invention is shown in FIGS. 34–36 as a two-piece hinge arrangement and in FIGS. 37–40 as a three-piece telescoping hinge arrangement 20B'. Several items of hinge 20B are comparable to hinge 20A, at hence cooperating members are identified by using the letter "B" as a suffix instead of the letter "A" to simplify the discussion hereinafter.

As shown in FIGS. 37–40, hinge assembly 20B includes a hinge base 22B adapted to attach to a vehicle 24B, a panel bracket 26B adapted to attach to a vehicle body panel such as a rear gate 28B, and a hinge member 30B' (FIGS. 38 and 40, modified from hinge member 30B) pivotally connected to the hinge base 22B and slideably connected to the panel bracket 26B (FIGS. 37–40). Alternatively, like hinge 20A, hinge 20B may be a two-piece, non-extendable assembly using hinge member 30B (FIGS. 22–24 and 34–36). Notably, hinge 20B offers weight savings and also less waste from scrap material when forming hinge 20B than when forming hinge 20A, and for these reasons may be preferable over hinge 20A.

Hinge member 30B (FIGS. 22–24) is a part stamped from a single sheet of metal, preferably about 13 gauge (0.090 inch) HRPO steel. Hinge member 30B includes an attachment portion formed by a planar section 34B with holes 36B therein for attaching hinge member 30B to an exposed side of body panel 28B. Hinge member 30B further includes spaced flanges 44B and 46B that extend perpendicularly from opposite sides of planar section 34B. A pair of spaced apart arms 60B and 62B interconnected by planar section 63B extend from flanges 44B, 46B and planar section 34B respectively. Members 34B, 44B, 46B, 60B, 62B and 63B form a "camelback" bend as previously described in the second embodiment. Arms 60B and 62B include aligned inwardly extruded holes 68B and 70B. Flanges 72B and 74B extend inwardly from the ends of arms 60B and 62B, flanges 72B and 74B preventing over-travel of hinge 20B. It is noted that flanges 72B and 74B provide a similar function to flanges 72A and 74A in hinge 20A, however flanges 72B and 74B are positioned on a lateral side of arms 60B and 62B instead of on the extreme ends thereof.

Figure 28:
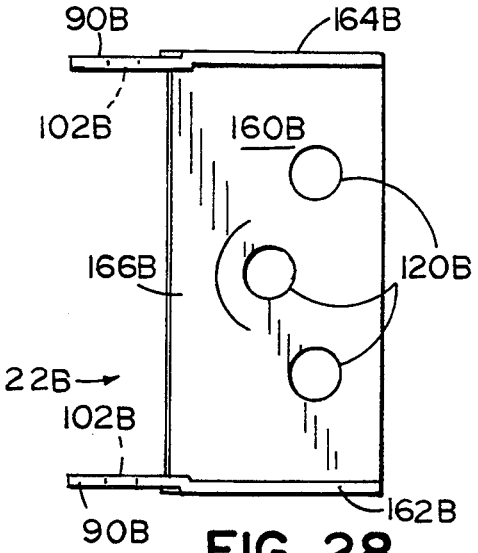
FIGS. 28–30 are orthogonal views of a hinge base for use in the third hinge assembly.
Figure 30:
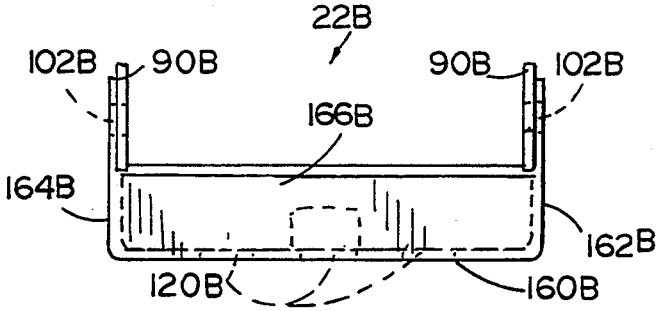
Figure 29:
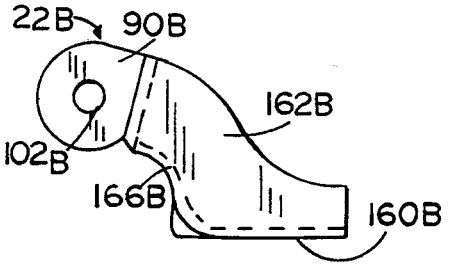

Hinge base 22B (FIGS. 28–30) is also a part stamped from a single sheet of metal preferably about 13 gauge (0.090 inch) HRPO steel. Hinge base 22B includes a one-piece attachment flange 160B, and further includes side flanges 162B and 164B and a central shaped flange 166B, members 160B, 162B, 164B and 166B forming a "camelback" arrangement as previously described. A pair of ear-like flanges 90B and 92B with holes 102B therein extend from the end of side flanges 162B and 164B.

The two-piece hinge arrangement of hinge 20B is shown in FIGS. 34–36, and includes hinge member 30B and hinge base 22B.

Figure 25:
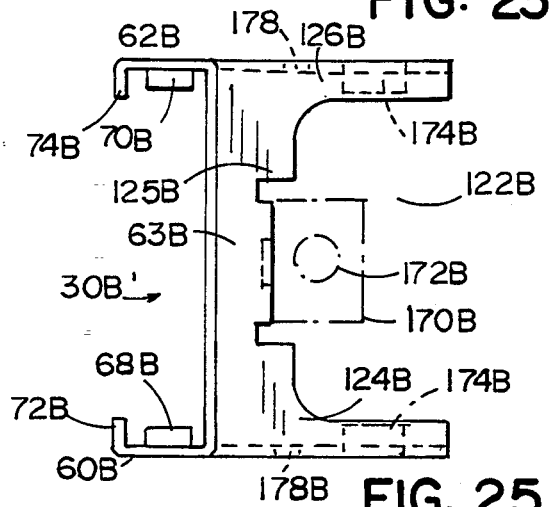
FIGS. 25–27 are orthogonal views of the hinge member shown in FIGS. 22–24 but modified for use in a three-piece telescoping hinge arrangement as shown in FIGS. 37–40.
Figure 27:
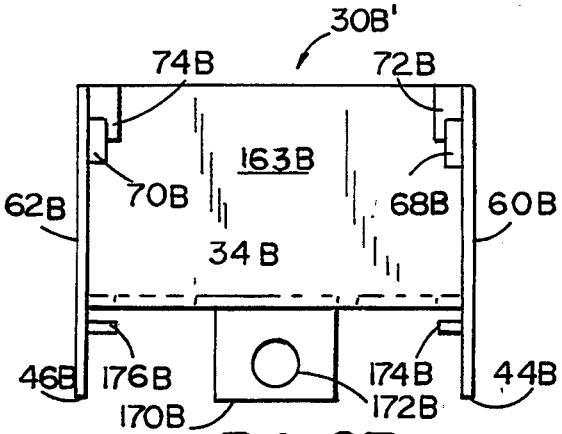
Figure 26:
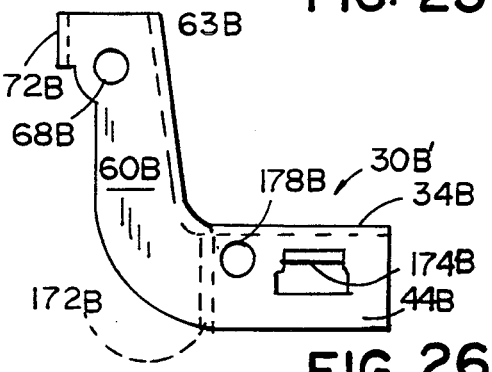

Hinge member 30B can be modified to form hinge member 30B' (FIGS. 25–27) so that hinge 20B can be made into a three-piece hinge arrangement. In particular, hinge member 30B' includes forming aperture 122B in hinge member 30B, but with a centrally located tab 170B not being removed. Tab 170B includes a hole 172B and is shown in phantom in its original stamped condition in FIG. 25, but is bent downwardly perpendicular as shown in all FIGS. 25–27. Aperture 122B is thus defined by flanges 124B, 125B and 126B which extend around three sides of aperture 122B. Also, side tabs 174B and 176B are formed in sides 60B and 62B, and holes 178B are formed immediately behind but spaced from tabs 174B and 176B.

Figure 31:
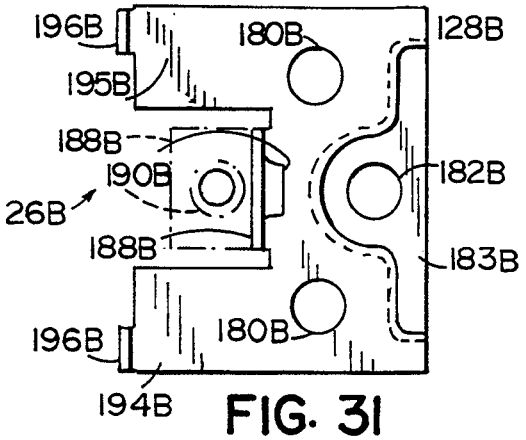
FIGS. 31–33 are orthogonal views of a panel bracket for use in the third hinge assembly.
Figure 33:
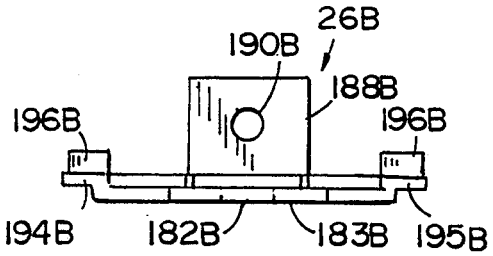
Figure 32:
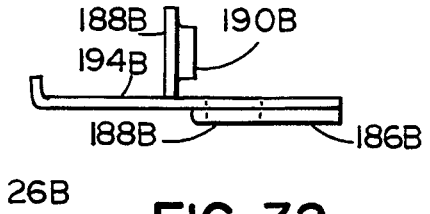
Figure 38:
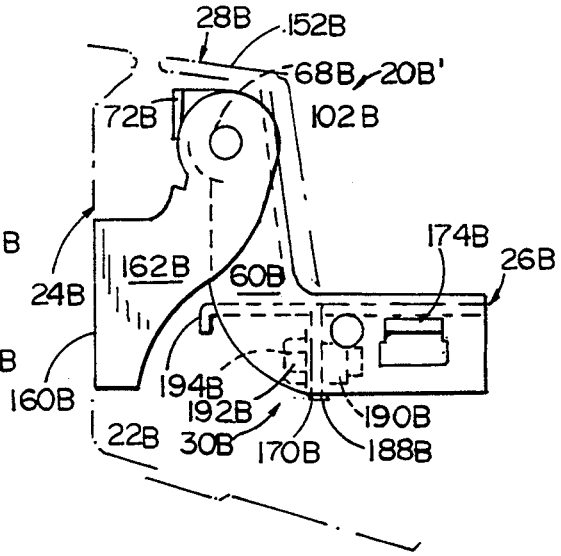

Hinge panel bracket 26B (FIGS. 31–33) is also stamped from sheet metal, preferably about 13 gauge (0.090 inch) HRPO steel, and includes an attachment plate portion 128B with two holes 180B and a single hole 182B stamped therein in a triangular fashion. Holes 180B are extruded. Hole 182B is not extruded, but is located in a depressed area 183B on attachment plate portion 128B such that the lower surface 186B located around hole 182B aligns with the lower end 188B of extruded holes 180B (FIG. 32). A center tab 188B with extruded hole 190B is formed perpendicularly to attachment plate portion 128B. Center tab 188B is adapted to abut tab 170B on hinge member 30B when three-piece hinge 20B is in the fully retracted position (FIG. 38). When fully retracted, holes 190B and 172B align such that a bolt 192B can be secured therein to securely hold panel bracket 26B in the retracted position on hinge member 30B (FIG. 38). Hinge panel bracket 26B further includes arms 194B and 195B which extend rearwardly on either side of center tab 188B, rear arms 194B and 195B including tabs 196B at the outer rear extremity of rear arms 194B and 195B. Tabs 196B are positioned to abut side tabs 174B and 176B on hinge member 30B when hinge panel bracket 26B is extended (FIG.

40). Notably, when extended, side tabs 196B are located between tabs 196B and holes 178B such that a bolt or pin can be placed through holes 178B to trap side tabs 196B and thus hold panel bracket 26B in the extended position. It is contemplated that panel bracket 26B can be held in the extended position merely by sliding a pin into holes 178B, although it is noted that the bolt could be threaded into holes 178B or otherwise more permanently secured therein.

The operation of hinge 20B in either the two-piece hinge arrangement (FIGS. 34–36), and also in the three-piece hinge arrangement (FIGS. 37–40), is otherwise self-explanatory based on the previous discussion and in particular based on the discussion of the second embodiment, hinge 20A.

FOURTH EMBODIMENT

Figure 41:
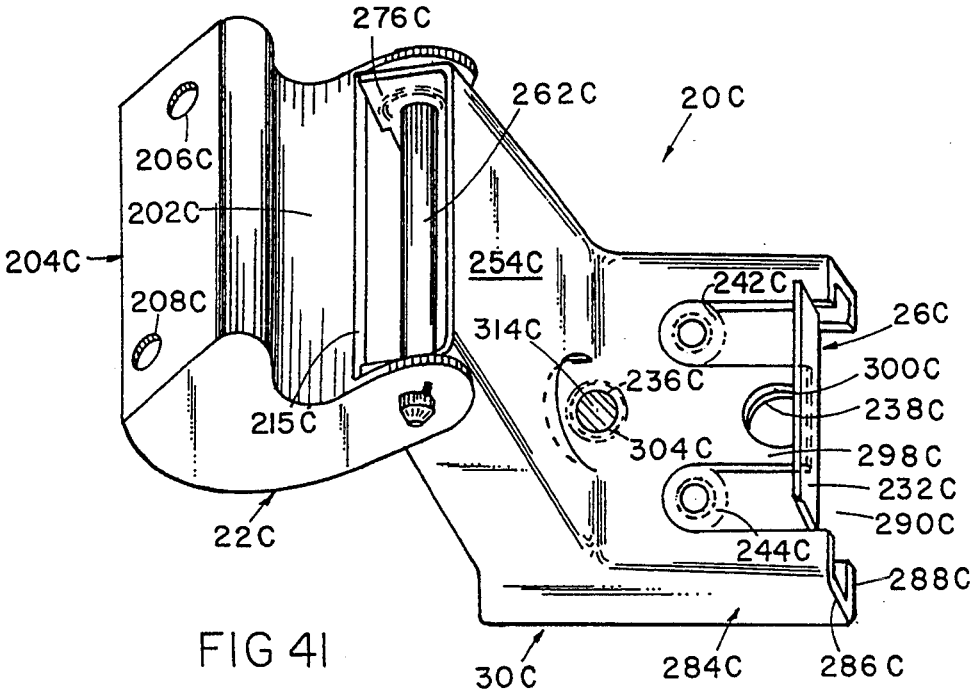
FIG. 41 is a perspective view of a fourth hinge assembly embodiment of the present invention, the hinge assembly being in the retracted position
Figure 42:
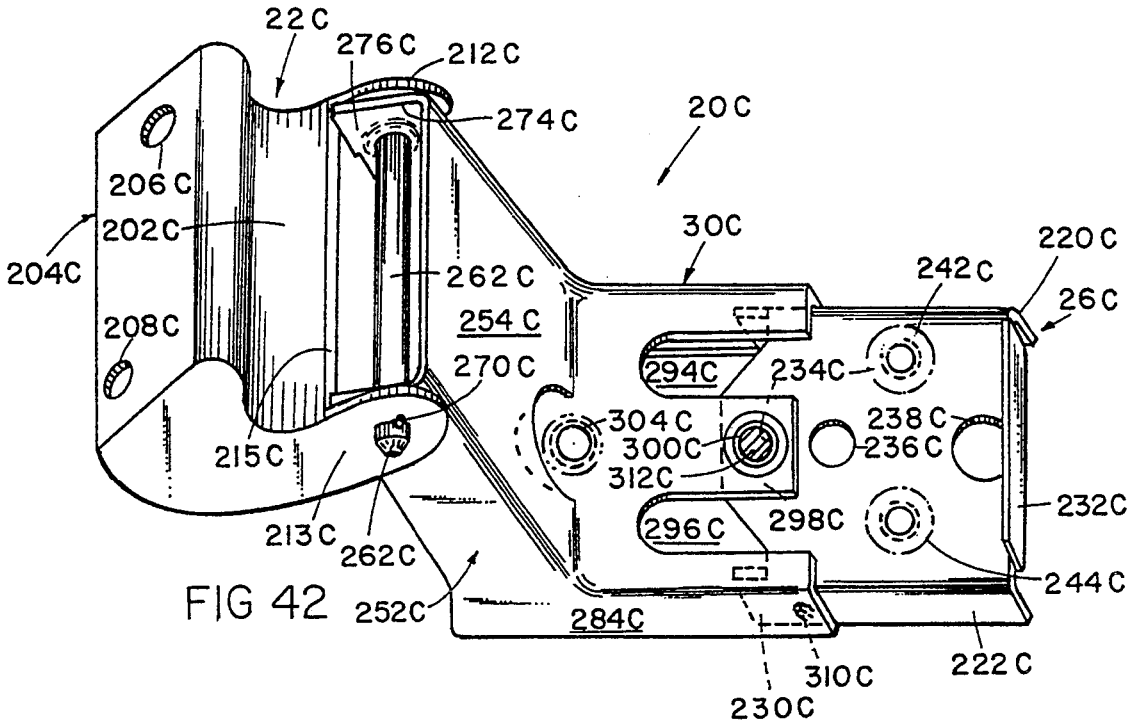
FIG. 42 is a perspective view of the hinge assembly shown in FIG. 41 but with the hinge assembly being in the extended position.
Figure 55:
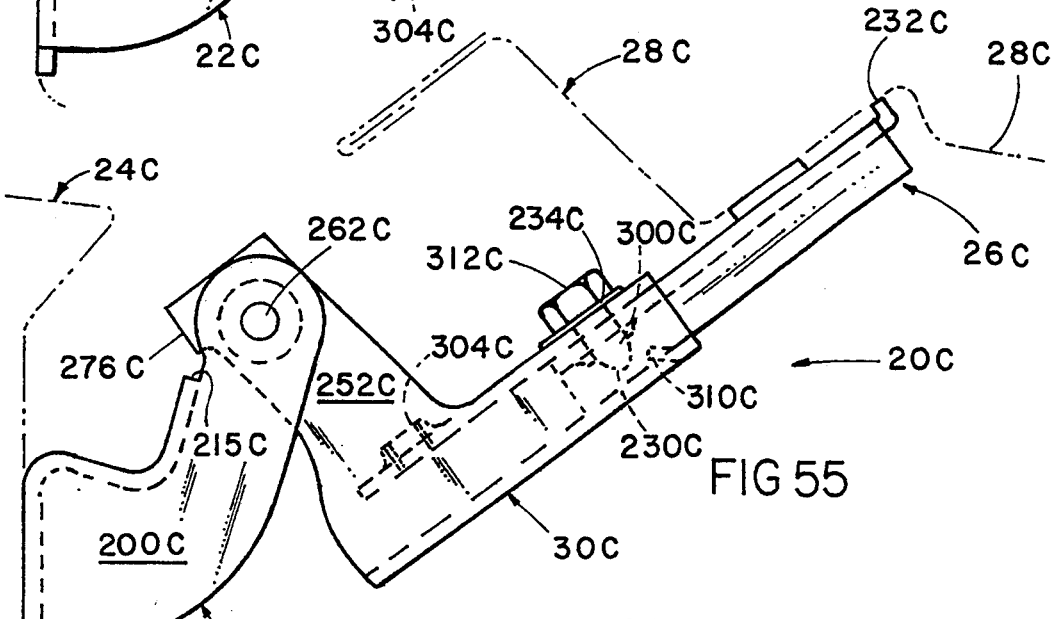
FIG. 55 is an elevational view of the hinge assembly in a position comparable to that of FIG. 54 but with the assembly in the extended position.
Figure 56:
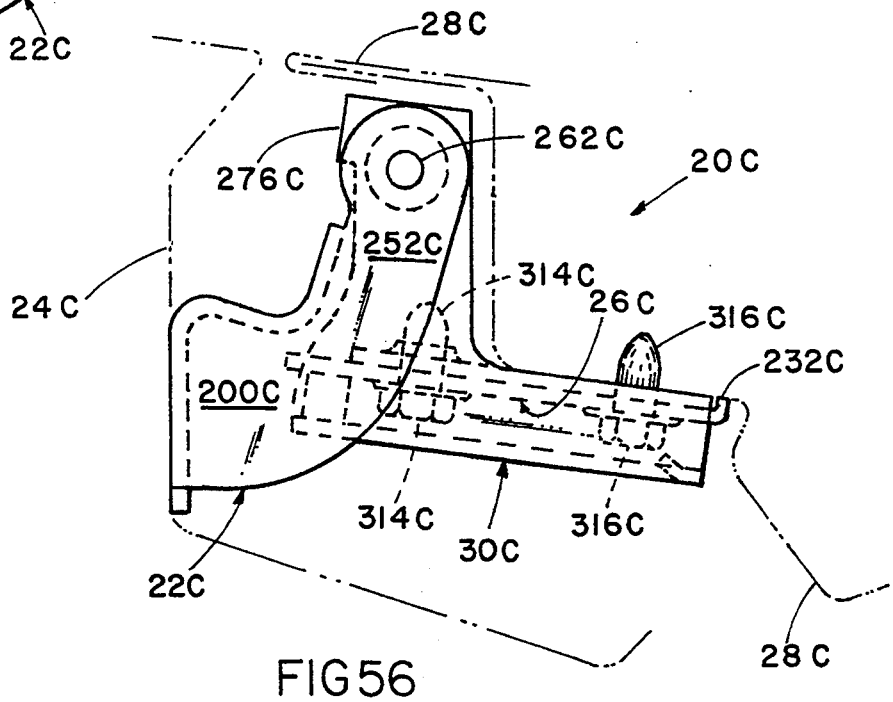
FIG. 56 is an elevational view of the hinge assembly of FIG. 41, but with the assembly being in the closed position and, like FIG. 54, being in the retracted position.

A hinge 20C (FIGS. 41, 42, 54 and 55) embodying the present invention includes a hinge base 22C adapted to attach to a vehicle, a panel bracket 26C adapted to attach to a vehicle body panel such as rear gate or trunk lid 28C (FIG. 54), and a hinge member 30C pivotally connected to the hinge base 22C and slideably connected to the panel bracket 26C. Hinge base 22C, panel bracket 26C and hinge member 30 are each stamped from separate pieces of sheet metal without the need for secondary operations such as welding, riveting, or the like. Hinge 20C is extendable (FIGS. 42 and 55) so that body panel 28C can be moved to provide clearance between vehicle 24C and body panel 28C to facilitate simultaneously painting hinge 20C, the vehicle 24C, the body panel 28C, and the area therebetween, without removing body panel 28C from the vehicle 24C. Hinge 20C can also be positioned in a retracted position (FIGS. 41, 54 and 56) for optimal aesthetics.

Figure 43:
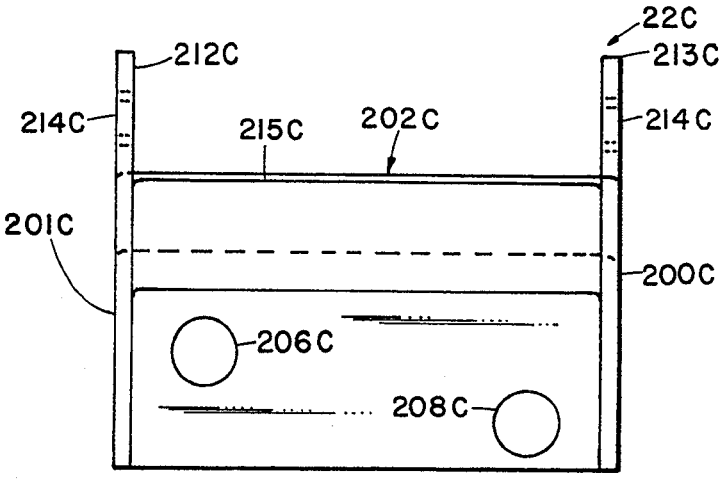
FIGS. 43–44 are orthogonal views of the hinge base of the assembly shown in FIG. 41.
Figure 44:
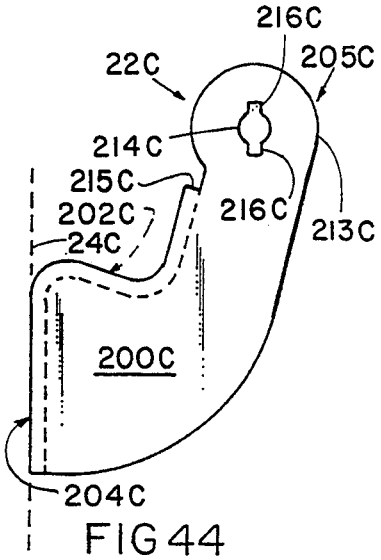

Hinge base 22C (FIGS. 43 and 44) includes L-shaped opposing sides or flanges 200C and 201C connected by a continuously shaped center flange 202C. The vehicle mounting end 204C of center flange 202C is substantially flat and includes holes 206C and 208C for receiving bolts (not shown) for securing hinge base 22C to vehicle 24C. The pivot supporting end 205C extends from mounting end 204C and includes ears 212C and 213C of side flanges 200C and 201C, respectively that extend beyond a trailing edge 215C of center flange 202C opposite vehicle mounting end 204C of center flange 202C. Ears 212C and 213C each include a hole 214C with opposing depressions 216C formed radially into the perimeter of holes 214C.

Hinge base 22C is formed from a flat blank of sheet metal. As can be seen by viewing FIGS. 43 and 44, considerable stretching and deformation of material occurs as the material is formed into the U-shaped section defined by sides 200C and 201C and center flange 202C. As previously described, the shaped section formed is called a "camelback" bend, and is particularly structurally strong, both because of the work-hardening of material due to the formation of the bend and also due to the complex shape formed by the sides 200C and 201C and the center flange 202C. In particular, sides 200C and 201C reinforce the shape of center flange 202C, and the non-planar shape of center flange 202C reinforces and supports the shape of sides 200C and 201C.

Figure 48:
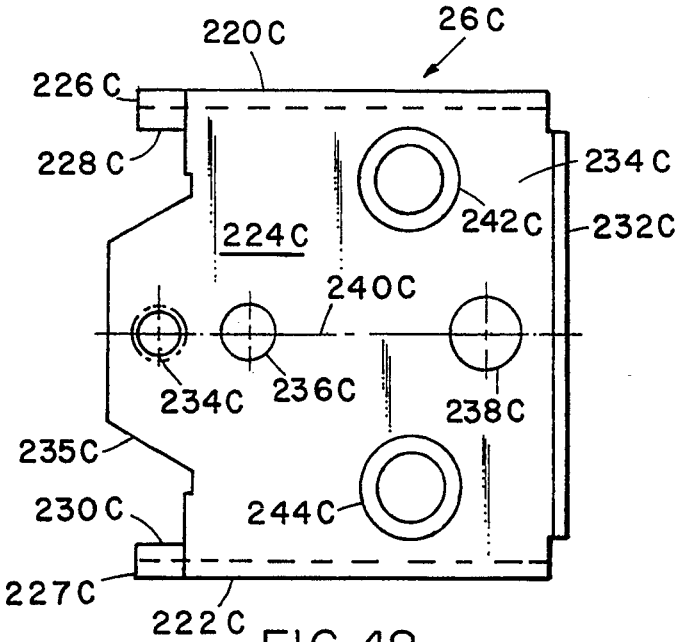
FIGS. 48–50 are orthogonal views of the panel bracket of the assembly shown in FIG. 41.
Figure 49:
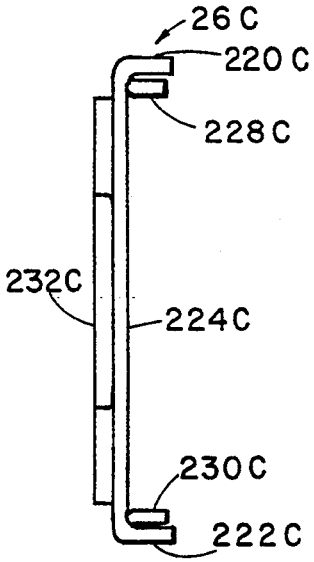
Figure 50:
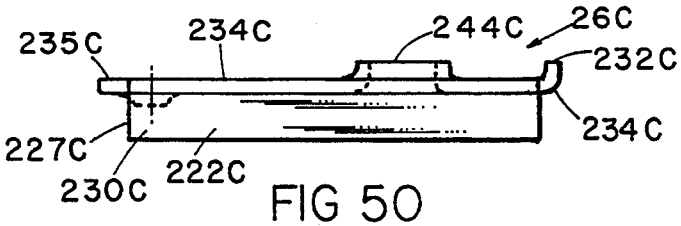

Panel bracket 26C (FIGS. 48–50) includes a slide defined by a connecting flange 224C, and opposing side flanges 220C and 222C extending from the sides of connecting flange 224C. The leading ends 226C and 227C of opposing side flanges 220C and 222C, respectively, are bent inwardly to form double thick flanges or stops 228C and 230C, respectively. An engaging flange or stop 232C is formed along the trailing end 234C of connecting flange 224C, stop 232C being bent in an opposite direction from flanges 220C and 222C. Flanges 220C, 222C and 232C reinforce flange 224C. Three holes 234C, 236C and 238C are formed along the longitudinal center line 240C of panel bracket 26C in connecting flange 224C to thus define a panel mounting section on panel bracket 26C. The forwardmost hole 234C is positioned on a forwardly extending tab 235C, and is formed by material extruded downwardly in the direction of side opposing flanges 220C and 222C. A pair of extruded holes 242C and 244C are formed on opposite sides of center line 240C in connecting flange 224C, the material forming extruded holes 242C and 244C being extruded upwardly opposite the direction of hole 234C.

Figure 45:
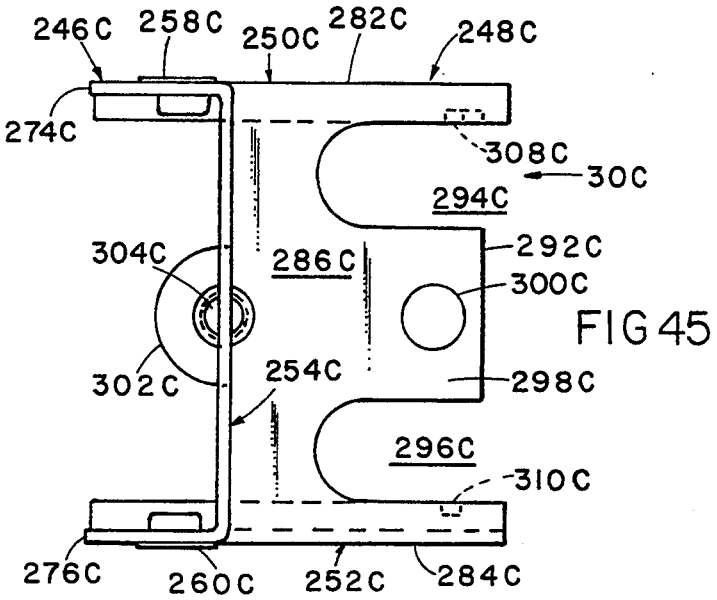
FIGS. 45–47 are orthogonal views of the pivotable hinge member of the assembly shown in FIG. 41.
Figure 46:
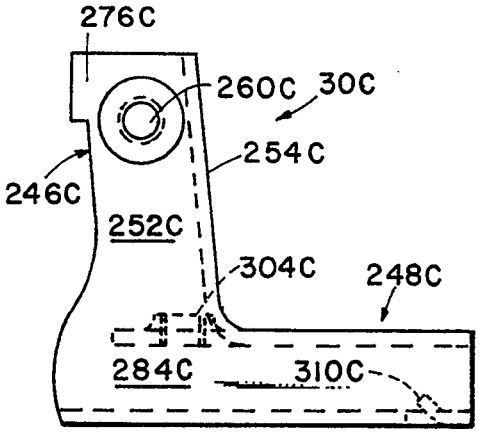
Figure 51:
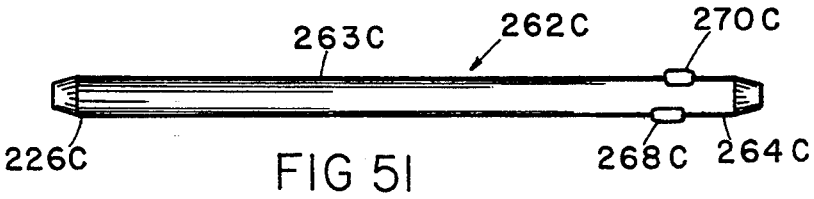
FIGS. 51–52 are orthogonal views of the hinge pin of the assembly shown in FIG. 41.
Figure 52:
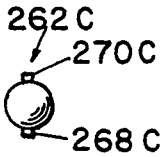
Figure 53:
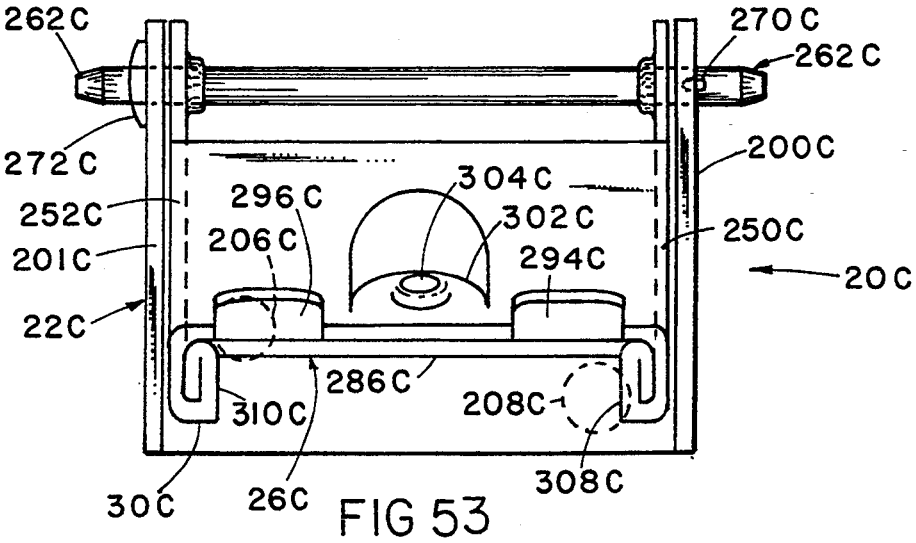
FIG. 53 is an end view of the hinge assembly shown in FIG. 41 but with the panel/deck lid removed for clarity.

Hinge member 30C (FIGS. 45–47) includes a pivot supporting end 246C and a slide receiving end 248C extending from pivot supporting end 246C. Hinge member ends 246C and 248C are formed by L-shaped opposing sides or flanges 250C and 252C and a center connecting flange 254C connecting sides 250C and 252C. Flanges 250C, 252C and 254C extend in a first direction to form the U-shaped cross section of pivot supporting end 246C. A pair of holes 258C and 260C are formed in opposing sides 250C and 252C in pivot supporting end 246C, the material forming holes 258C ad 260C being extruded inwardly toward each other. A pivot pin 262C (FIGS. 51 and 52) includes a shaft 263C and ends 264C and 266C. Pin end 264C has at least one protrusion 268C adapted to engage depressions 216C on hinge base 22C as shaft 263C is extended through holes 214C in hinge base 22C and through holes 258C and 260C in hinge member 30C. A second protrusion 270C on pin end 264C limits the longitudinal travel of pivot pin 262C into hinge member 30C. A spring steel retainer or locking washer 272C (FIG. 53) slides onto and lockingly engages pivot pin end 266C to thus retain pivot pin 262C in position. Thus, pivot pin 262C pivotally connects hinge member 30C to hinge base 22C. The purpose of opposing protrusion 268C is to cause hinge member 30C to rotate on pivot pin 262C so that the rotation occurs between pivot pin 262C and hinge member 30C thus causing wear on the extruded holes 258C and 260C. In turn, pivot pin 262C does not rotate in hinge base holes 214C, which holes are not extruded and thus which have a smaller bearing surface.

The terminal end of pivot supporting end 246C (FIGS. 45–47) includes projections 274C and 276C on sides 250C and 252C, respectively. Tabs 274C and 276C prevent over-rotation of hinge member 30C on hinge base 22C by engaging the trailing edge 215 of center flange 202C on hinge base 22C (FIG. 44) when hinge member 30C is pivoted to the full open position.

The slide receiving end 248C (FIGS. 45–47) is formed by extensions of opposing sides 250C and 252C and connecting flange 254C. The extension of L-shaped opposing sides 250C and 252C along with connecting flange 254C between pivot supporting end 246C and slide receiving end 248C form a "camelback" bend having increased strength as previously described. Specifically, slide receiving end 248C includes extensions 282C and 284C of opposing sides 250C and 252C, respectively, and further includes an extension 286C of connecting flange 254C. Extensions 282C and 284C

(FIG. 47) are L-shaped having a side leg 286C and an inwardly bent lower flange or leg 288C. Slide receiving end 248C defines a rectangular track 290C having rectangular dimensions D1 and D2 which are adapted to slidingly receive panel bracket 26C, the width dimension D1 preferably being about six times the height dimension D2 to provide a low profile.

Connecting flange extension 286C (FIG. 45) includes a trailing edge 292C. A pair of slots 294C and 296C that extend longitudinally (i.e. parallel the direction of track 290C) from trailing edge 292C, thus defining a tab 298C between slots 294C and 296C. A hole 300C is formed in tab 298C. A second tab 302C is formed in hinge member 30C. Tab 302C extends from center flange 286C through flange 254C and is formed from a section of material from flange 254C. Tab 302C is located at the heart of the "camelback" bend. However, the limited width and depth of second tab 302C prevents it from adversely affecting the strength of the "camelback" bend. Further, the formation of second tab 302 allows increased space between a hole 304C formed in second tab 302C and the hole 300C in tab 298C. This allows hinge member 30C to be made shorter, an important feature since space is limited on the vehicle in the area of hinge 20C. Second tab hole 304C is extruded upwardly away from track 290C so that it does not interfere with track 290C.

Figure 47:
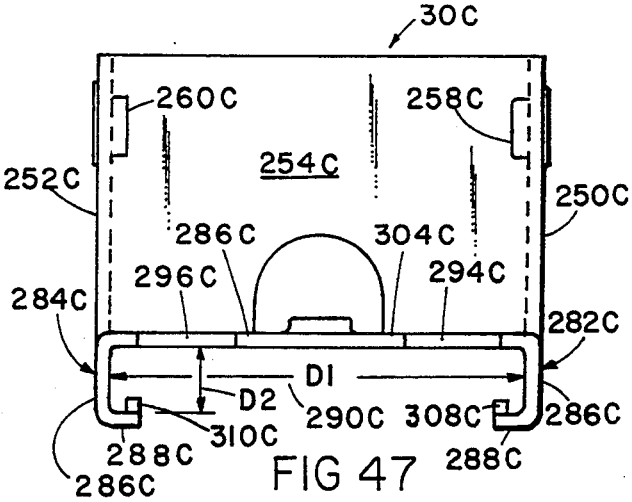
Figure 54:
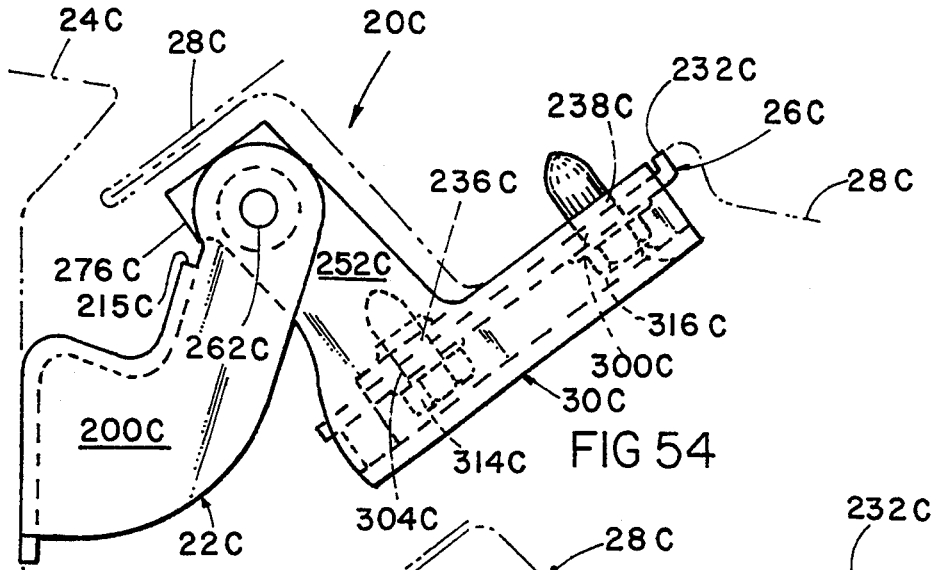
FIG. 54 is an elevational view of the hinge assembly shown in FIG. 41, the assembly being in the retracted position and being held partially open.

To assemble hinge 20C, panel bracket 26C is initially placed in track 290C of hinge member 30C. This positions opposing sides 220C and 222C of panel bracket 26C (FIG. 49) inside and adjacent opposing sides 282C and 284C of hinge member 30C (FIG. 47). Further, this positions connecting flange 224C of panel bracket 26C (FIG. 49) under and adjacent connecting flange 286C of hinge member 30C (FIG. 47). Once panel bracket 26C is fully slideably received within track 290C of hinge member 30C, a pair of second stops 308C and 310C (FIGS. 45–47) are formed in the lower leg 288C of side flanges 282C and 284C. Stops 308C and 310C are bent upwardly into the rectangular dimensions of track 290C so that when panel bracket 26C is extended, stops 308C and 310C engage double thick flanges or stops 228C and 230C, respectively (FIGS. 48 and 49) to limit the extension of panel bracket 26C on hinge member 30C. As panel bracket 26C is retracted into hinge member 30C, stop 232C abuts the trailing end of tab 298C to limit the retracting movement (FIG. 54). When fully retracted, holes 236C and 238C in panel bracket 26C align with holes 304C and 300C, respectively, in hinge member 30C. A pair of bolts 314C and 316C (FIGS. 41, 54 and 56) secure hinge 20C in the retracted position. When in the extended position (FIG. 55), hole 234C in panel bracket 26C aligns with hole 300C in hinge 30C. A bolt 312C (FIGS. 42 and 55) secures hinge 20C in the extended position. Notably, in either of the retracted or extended positions, holes 242C and 244C are exposed so that panel bracket 26C can be secured to rear gate 28C and the hinge 20C can still be extended/retracted. Notably, bolts 312C and 314C are installed in opposite directions to facilitate assembly.

Thus, four embodiments of hinges are provided that are telescopingly slideable to an extended position for providing increased clearance between an associated body panel and vehicle to facilitate painting or other manufacturing operations without requiring that the body panel be disconnected from the vehicle, the hinges also being telescopingly slideable to a retracted position for providing an acceptably close final assembly fit of the body panel to the vehicle.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The embodiments of the invention in which an exclusive property or privilege is claimed are defined as follows.

1. A hinge comprising:

a first hinge member adapted for attachment to a vehicle body;

a second hinge member pivotally connected to said first hinge member and including first opposing flanges and a first connecting flange interconnecting said first opposing flanges, said first opposing flanges and said first connecting flange defining a track;

a third hinge member slideably connected to said second hinge member for movement between a retracted position and an extended position, said third hinge member including second opposing flanges and a second connecting flange interconnecting said second opposing flanges to thus define a slide, said second opposing flanges and said second connecting flange being shaped to slideably mateably engage said track so that said third hinge member is moveable along said track; and at least one stop located on one of said second and third hinge members for engaging the other of said second and third hinge members to limit the movement of said third hinge member relative to said second hinge member, said at least one stop defining at least one of said retracted and extended positions.

2. A hinge as defined in claim 1 wherein said first connecting flange includes a first hole and said second connecting flange includes second and third holes, said first and second holes aligning when said third hinge member is in said retracted position, and said first and third holes aligning when said third hinge member is in said extended position.

3. A hinge as defined in claim 2 wherein said first connecting flange includes a pair of spaced slots extending longitudinally in the direction defined by said track, and said second connecting flange includes a pair of spaced holes that align with said slots when in the retracted position.

4. A hinge as defined in claim 3 wherein said first connecting flange defines a plane, and said second connecting flange includes extruded material defining said pair of spaced holes, said extruded material extending at least partially into said slots when in said retracted position.

5. A hinge as defined in claim 1 wherein one of said first and second connecting flanges includes an extruded hole engageable by a self-tapping threaded fastener, and the other of said first and second connecting flanges includes an alignable hole that can be aligned with said extruded hole when said third hinge member is in the extended position, whereby a self-tapping threaded fastener can be extended through said aligned hole and threadingly into said extruded hole to secure said hinge in said extended position.

6. A hinge as defined in claim 5 wherein one of said first and second connecting flanges includes a second extruded hole and the other of said first and second connecting flanges includes a second alignable hole that can be aligned with said second extruded hole when said third hinge member is in said retracted position, whereby self-tapping threaded fastener can be extended through said second alignable hole and threadably into said second extruded hole to secure said hinge in said retracted position.

7. A hinge as defined in claim 1 wherein said first connecting flange includes first and second holes, and said second connecting flange includes third, fourth and fifth holes, said first and third holes being alignable when said hinge is in said extended position, and said first and second holes being alignable with said fourth and fifth holes, respectively, when said hinge is in said retracted position.

8. A hinge as defined in claim 7 wherein said first connecting flange includes a pair of slots aligned with the direction defined by said track, and said second connecting flange includes sixth and seventh holes that are positioned in alignment with said slots when said hinge is in said retracted position.

9. A hinge as defined in claim 1 wherein said first opposing flanges include a pair of first bent tabs, and said second opposing flanges include a pair of second bent tabs, said first and second bent tabs engaging to form a first stop.

10. A hinge as defined in claim 9 wherein said second connecting flange includes a trailing bent flange that abuts an end of said first connecting flange to form a second stop.

11. A hinge as defined in claim 1 wherein said first hinge member includes first pivot holes, and said second hinge member includes second pivot holes, at least one of said first and second pivot holes being defined by extruded material that provides an increased bearing surface, and at least one of the other of said first and second pivot holes including depressions in the perimeter of the one other hole, and including a pivot pin having an end with deformed sections proximate the end, said pivot pin being adapted to engage said first and second pivot holes and said deformed section being adapted to engage said depressions in said one other pivot hole, whereby said pivot pin rotates on said extruded material of said one pivot holes and not on said other pivot holes when said hinge is used.

12. A hinge as defined in claim 1 wherein said third hinge member when viewed longitudinally along said track has a rectangular profile wherein the width is at least about six times the height, thus providing a low profile.

13. A hinge as defined in claim 1 wherein said second connecting flange includes a trailing end and a bent flange that extends along the trailing end, said second opposing flanges and said bent flange reinforcing three sides of said third hinge member.

14. A hinge comprising:

a first hinge member including a vehicle mounting end defining a U-shaped section and a first pivot supporting end defining a U-shaped section extending from said vehicle mounting end, said vehicle mounting end and said first pivot supporting end including continuous flanges and being oriented at an angle to each other so as to define a first camelback bend;

a second hinge member including a second pivot supporting end defining a U-shaped section and a slide receiving end defining a U-shaped section, said second pivot supporting end and said slide receiving end including continuous flanges and being oriented at an angle to each other so as to define a second camelback bend said first and second pivot supporting ends being pivotally interconnected and a third hinge member including a vehicle panel mounting end and a slide configured with opposing edges for slideably engaging the slide receiving end of said second hinge member, said third hinge member being moveable between an extended position and a retracted position on said second hinge member end including means for limiting the movement of said third hinge member to the extended and retracted positions.

15. A hinge as defined in claim 14 wherein said slide receiving end of said second hinge member includes a first hole and said slide of said third hinge member includes second and third holes, said first and second holes aligning when said third hinge member is in said retracted position, and said first and third holes aligning when said third hinge member is in said extended position.

16. A hinge as defined in claim 15 wherein said slide receiving end includes a pair of spaced slots extending longitudinally in the direction defined by said track, and said slide includes a pair of spaced holes that align with said slots when said third hinge member is in the retracted position.

17. A hinge as defined in claim 16 wherein said slide receiving end defines a plane, and said slide includes extruded material defining said pair of spaced holes, said extruded material extending at least partially into said slots when said third hinge member is in said retracted position.

18. A hinge as defined in claim 14 wherein one of said slide receiving end and said slide includes an extruded hole engageable by a self-tapping threaded fastener, and the other of said slide receiving end and said slide includes an alignable hole that aligns with said extruded hole when said third hinge member is in said retracted position, whereby the self-tapping threaded fastener can be extended through said aligned hole and threadingly into said extruded hole to secure said hinge in said retracted position.

19. A hinge as defined in claim 18 wherein one of said slide receiving end and said slide includes a second extruded hole engageable by another self-tapping threaded fastener, and the other of said slide engaging end and said slide includes a second alignable hole that is alignable with said second extruded hole when said third hinge member is in said extended position, whereby the other self-tapping threaded fastener can be extended through said second alignable hole and threadably into said second extruded hole to secure said hinge in said retracted position.

20. A hinge as defined in claim 14 wherein said slide receiving end includes first and second holes, and said slide includes third, fourth and fifth holes, said first and third holes being alignable when said third hinge member is in the extended position, and said first and second holes being alignable with said fourth and fifth holes when said third hinge member is in said retracted position.

21. A hinge as defined in claim 14 wherein said slide receiving end includes a pair of slots aligned with the direction defined by said track, and said slide includes sixth and seventh holes that align with said pair of slots when said third hinge member is in said retracted position.

22. A hinge as defined in claim 14 wherein said slide receiving end includes a pair of inwardly bent first tabs, and said slide includes a pair of second bent tabs, said first and second bent tabs being engageable to form a first stop that defines said extended position, said first stop forming a part of said means for limiting movement.

23. A hinge as defined in claim 14 wherein said third hinge member when viewed longitudinally along said track has a rectangular profile wherein the width is at least about six times the height.

24. A hinge as defined in claim 14 wherein said slide includes a trailing end and a bent flange extending along said trailing end for abuttingly engaging said second hinge member to thus define said retracted position, and further includes opposing side flanges, said opposing side flanges and said bent flange reinforcing three sides of said third hinge member.

* * * * *